US006990300B2

(12) United States Patent
Saito et al.

(10) Patent No.: US 6,990,300 B2
(45) Date of Patent: Jan. 24, 2006

(54) IMAGE FORMING APPARATUS WITH BIAS AND INTEGRAL CURRENT CONTROL FEATURES

(75) Inventors: Makoto Saito, Hitachinaka (JP); Takeshi Tomizawa, Kashiwa (JP); Jun Mochizuki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 116 days.

(21) Appl. No.: 10/671,690

(22) Filed: Sep. 29, 2003

(65) Prior Publication Data

US 2004/0131373 A1 Jul. 8, 2004

(30) Foreign Application Priority Data

Sep. 30, 2002 (JP) ..... 2002-287217
Sep. 4, 2003 (JP) ..... 2003-312980

(51) Int. Cl.
*G03G 15/16* (2006.01)

(52) U.S. Cl. ..... 399/101

(58) Field of Classification Search ..... 399/66, 399/101, 299, 306, 314
See application file for complete search history.

(56) References Cited

U.S. PATENT DOCUMENTS 5,196,885 A * 3/1993 Takeuchi et al. ..... 399/168
5,287,144 A * 2/1994 Takeda ..... 399/66
5,822,649 A * 10/1998 Karashima et al. ..... 399/66
5,832,335 A * 11/1998 Fukasawa ..... 399/66
6,167,212 A 12/2000 Satoh et al. ..... 399/55
6,173,135 B1 * 1/2001 Yuminamochi et al. ..... 399/66
6,272,306 B1 8/2001 Saito et al. ..... 399/270
6,434,348 B1 8/2002 Tomizawa ..... 399/66
6,735,402 B2 * 5/2004 Oki ..... 399/66
6,766,125 B1 * 7/2004 Izumi ..... 399/66

FOREIGN PATENT DOCUMENTS

JP 03233484 A * 10/1991
JP 06067517 A * 3/1994
JP 7-49604 2/1995

* cited by examiner

*Primary Examiner*—Robert Beatty
(74) *Attorney, Agent, or Firm*—Fitzpatrick, Cella, Harper & Scinto

(57) ABSTRACT

An image forming apparatus includes an image forming device for forming a toner image on an image bearing member, a transfer member for transferring the toner image from the image bearing member onto a transfer material by being supplied with a bias voltage, a bias voltage application device for applying a normal bias voltage of a polarity opposite to that of toner or a reverse bias voltage opposite in polarity to the normal bias voltage, a controller for controlling the bias voltage application device, and integral current detector for detecting an integral of an amount of a current flowing from the bias voltage application device to the transfer member. The integral current detector is capable of detecting an integral current amount of the normal bias voltage at the time of applying the normal bias voltage and an integral current amount of the reverse bias voltage at the time of applying the reverse bias voltage. The controller controls the bias voltage application device so that an absolute value of the integral current amount of the reverse bias voltage is in the range of not less than 0.2% and less than 25% of an absolute value of the integral current amount of the normal bias voltage.

8 Claims, 17 Drawing Sheets

| REVERSE BIAS CURRENT AMOUNT (μA) | APPLICATION TIME (ROLLER CIRCUM-FERENCE) | TOTAL CURRENT AMOUNT OF REVERSE VIAS (μC) | TOTAL CURRENT RATO OF REVERSE BIAS / NORMAL BIAS | RESIDUAL TONER AMOUNT ON OUTER ROLLER (mg) |
|---|---|---|---|---|
| NO REVERSE BIAS | | 0 | 0 | 0.185 |
| 15 | 1 | 8.7 | 0.023 | 0.025 |
| 30 | 1 | 17.4 | 0.047 | 0.025 |
| 30 | 2 | 34.8 | 0.093 | 0.025 |
| 30 | 3 | 52.2 | 0.140 | 0.02 |
| 30 | 4 | 69.6 | 0.187 | 0.02 |
| 30 | 5 | 87 | 0.234 | 0.02 |
| 30 | 6 | 104.4 | 0.280 | 0.035 |
| 30 | 8 | 139.2 | 0.374 | 0.045 |
| 30 | 11 | 191.4 | 0.514 | 0.06 |
| 30 | 13 | 226.2 | 0.607 | 0.085 |
| 30 | 15 | 261 | 0.701 | 0.15 |

FIG. 13

IMAGE FORMING APPARATUS WITH BIAS AND INTEGRAL CURRENT CONTROL FEATURES

FIELD OF THE INVENTION AND RELATED ART

The present invention relates to an image forming apparatus, such as a printer, a copying machine, or a facsimile apparatus, for forming an image by transferring a toner image formed on an image bearing member onto a transfer material.

As an example of an image forming apparatus of the type wherein a toner image is transferred by using an intermediary transfer member as an image bearing member, there has been known an image forming apparatus as shown in FIG. 18.

Referring to FIG. 18 the image forming apparatus includes a photosensitive drum 1, which is rotationally driven in a direction of an arrow. The surface of the photosensitive drum is uniformly electrically charged by a charge roller 2 and then is subjected to irradiation with laser beam corresponding to image information by an exposure apparatus 3, whereby an electrostatic latent image is formed on the surface of the photosensitive drum. The electrostatic latent image is developed (visualized) by electrostatically adhering charged toner thereto by means of a developing apparatus 4.

The resultant toner image on the photosensitive drum 1 is primary transferred electrostatically onto an intermediary transfer belt 5 at an primary transfer station T1 by a primary transfer roller 6, an then is secondary transferred electrostatically onto a transfer material P to be carried in a direction of an arrow K1 at a predetermined timing, at a secondary transfer station T2 by a secondary transfer outer roller 14.

The transfer material P onto which the toner image is transferred is conveyed to a fixing apparatus 9 and is heated and pressed to have a fixed toner image on its surface.

In such an intermediary transfer type image forming apparatus, if the transfer material P is conveyed in a state that the secondary transfer outer roller 14 is contaminated with the toner, there is a possibility of backside contamination of the transfer material P. In order to obviate such a backside contamination of the transfer material P attributable to the contamination of the secondary transfer outer roller 14 with the toner, several methods have been known.

One of the methods prevents the backside contamination of the transfer material P by causing a cleaning member (not shown) to contact the secondary transfer outer roller 14 to wipe the toner contaminant. More specifically, a cleaning blade is caused to contact the secondary transfer outer roller 14, whereby the toner particles transferred onto the roller surface is cleaned to obviate the backside contamination of the transfer material P. Alternatively, it is possible to accomplish the purpose by causing an electroconductive brush to contact the secondary transfer outer roller 14 to recover electrostatically the toner particles with the brush.

However, such a method using the cleaning member is liable to complicate a structure of and increase in production cost of the image forming apparatus.

Further, in such a method using the cleaning member, there is a possibility that the cleaning member cannot withstand the use for a long period. For example, in the case where the cleaning blade is caused to contact, the secondary transfer outer roller 14 is pressed under a high pressure, so that the secondary transfer outer roller 14 is liable to be worn and a cleaning performance of the cleaning blade is also liable to be lowered. In addition, the surface of the worn secondary transfer outer roller 14 becomes smooth to increase a torque, so that the cleaning blade is liable to be turned up in a high humidity environment.

On the other hand, in the method of effecting cleaning with the electroconductive brush, when the brush is used for a long period, the charged toner particles are left remaining within the brush. As a result, the brush fails to hold the toner particles, so that there is a possibility that the toner particles are re-transferred and adhered onto the secondary transfer outer roller 14.

As described above, such a cleaning member mentioned above cannot retain stably a cleaning ability over a long term use, thus requiring a great increase in cost for retaining its performance such that it is accompanied with replacement of parts.

On the other hand, as a method of performing cleaning without providing the cleaning member to the secondary transfer outer roller 14, there is a method wherein a bias voltage of a polarity opposite to that at the time of the transfer process is applied to the secondary transfer outer roller 14, whereby the toner particles adhered to the surface of the secondary transfer outer roller 14 to be electrically adhered to the intermediary transfer belt 5, thus being recovered by an intermediary transfer cleaner 10.

Generally, when the transfer material P is nipped at the secondary transfer station T2 during image formation, the toner particles are not transferred onto the secondary transfer outer roller. However, in some cases where the transfer material P is not present at the secondary transfer station T2, there is a possibility that unintended toner particles are transferred from the intermediary transfer belt 5 onto the secondary transfer outer roller 14.

In other words, these cases correspond to such a case where the toner is borne in a non-image forming area on the intermediary transfer belt 5. For example such a case is accompanied with an occurrence of fog toner or toner patch formed between images.

Further, in the case where the transfer material P is conveyed to the secondary transfer station T2 at a timing later than the intended timing, a toner image which is to be ordinarily present at a leading end of a resultant image, is directly transferred onto the secondary transfer outer roller 14.

In order to obviate the transfer of the unintended toner particles in the case where they are conveyed to the secondary transfer station T1, such a method described above within the bias voltage of the opposite polarity to that at the time of ordinary image formation is accompanied with the following problems.

Unless an appropriate bias voltage is applied, there is a possibility that the toner is not transferred from the secondary transfer outer roller 14 onto the intermediary transfer belt 5.

This is attributable to a lesser known amount of the toner adhered to the surface of the secondary transfer outer roller 14 than the toner transferred onto the transfer material P in the ordinary image formation. For example, in the case where the fog toner is transferred and adhered to the secondary transfer outer roller 14 and is cleaned by the reverse polarity bias voltage, a much lesser amount of the toner than that of the ordinary toner image is electrostatically transferred from the secondary transfer outer roller 14 onto the intermediary transfer belt 5. Accordingly, it is possible to effect cleaning by applying a reverse bias voltage smaller than that at the ordinary image formation. In the case where if a transfer bias voltage identical in magnitude to that at the time of the ordinary image formation, it becomes excessively large for effecting the electrostatic transfer, thus lowering a transfer efficiency. As a result, there is a possibility that the cleaning of the fog toner is not performed effectively.

For this reason, it is necessary to select and apply an appropriate bias voltage as the reverse polarity bias voltage.

As described above, when the bias voltage of the opposite (reverse) polarity to that of the ordinary transfer bias voltage in order to obviate the contamination with toner adhered to the secondary transfer outer roller 14 by cleaning, if the timing of applying the reverse polarity bias voltage and the magnitude thereof are not appropriately selected, there are possibilities that productivity is impaired and that cleaning failure is liable to be visualized as the toner contamination on the backside of the transfer material P.

Japanese Laid-Open Patent Application No. HEI 07-49604 discloses such a technique that an appropriate range (relationship) between the integral of amount of positive current and that of negative current for the purpose of suppressing the increase in electric resistance with energization of a charging member to which both positive and negative bias voltages are applied, is described. However, in this document, optimization of cleaning of the transfer member is not described nor suggested.

SUMMARY OF THE INVENTION

In view of the above circumstances, the present invention has been accomplished.

An object of the present invention is to provide an image forming apparatus capable of effectively obviating an occurrence of backside contamination of a transfer material without employing a complicated structure.

According to the present invention, there is provided an image forming apparatus, comprising:

image forming means for forming a toner image on an image bearing member, a transfer member for transferring the toner image from the image bearing member onto a transfer material by being supplied with a bias voltage, bias voltage application means for applying a normal bias voltage of a polarity opposite to that of toner or a reverse bias voltage opposite in polarity to the normal bias voltage, control means for controlling the bias voltage application means, and integral current detection means for detecting an integral of an amount of a current flowing from the bias voltage application means to the transfer member, wherein the integral current detection means is capable of detecting an integral current amount of the normal bias voltage at the time of applying the normal bias voltage and an integral current amount of the reverse bias voltage at the time of applying the reverse bias voltage, and the control means controls the bias voltage application means so that an absolute value of the integral current amount of the reverse bias voltage is in the range of not less than 0.2% and less than 25% of an absolute value of the integral current amount of the normal bias voltage.

This and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 13 is a table showing a relationship among the current amount of the reverse bias voltage, an application time thereof, a total current amount thereof, a ratio between the total current amount of the reverse bias voltage to the total current amount of a normal bias voltage, and the residual toner amount on the secondary transfer outer roller.

DETAILED DESCRIPTION OF THE PREFERRED EMBODIMENT

Figure 1:
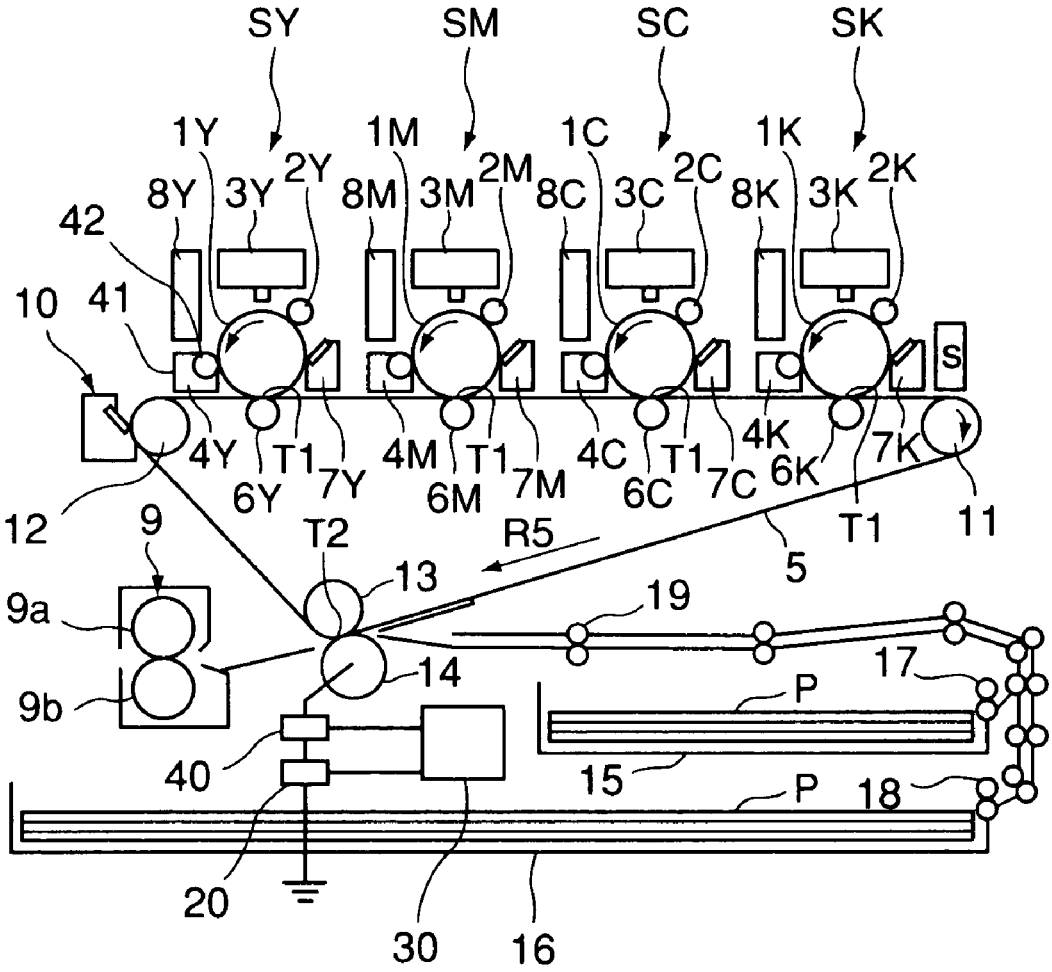
FIG. 1 is a schematic cross-sectional view showing a general structure of the image forming apparatus according to the present invention.

Hereinbelow, embodiments of the image forming apparatus of the present invention will be described with reference to the drawings.

In the following embodiments, however, it should be noted that dimensions, materials, and shapes of constitutional parts and their relative arrangement, etc., are not limitative unless otherwise specified. Further, reference numerals, materials, shapes, or the like, and used in common to all the embodiments unless otherwise noted.

<Embodiment 1>

FIG. 1 shows an image forming apparatus of this embodiment as an example of the image forming apparatus of the present invention. The image forming apparatus shown in FIG. 1 is a full-color laser beam printer, and FIG. 1 is a schematic cross-sectional view of a general structure thereof.

Referring to FIG. 1, the image forming apparatus is used for forming a full-color image by superposing four color toner images of yellow, magenta, cyan and black and includes four image forming stations SY, SM, SC and SK for forming color toner images of yellow, magenta, cyan and black, respectively, in this order.

The image forming stations SY, SM, SC and SK include drum type electrophotographic photosensitive members (hereinafter referred to as "photosensitive drum(s)" 1Y, 1M, 1C and 1K, respectively, as an image bearing member. Each of the photosensitive drums 1Y, 1M, 1C and 1K is prepared by coating an aluminum cylinder (outer diameter: 30 mm) with a photosensitive layer of OPC (organic photoconductor) and is rotationally driven in a direction shown by an arrow (a counterclockwise direction on the drawing of FIG. 1) at a predetermined process speed (peripheral speed). The surfaces of the photosensitive drums 1Y, 1M, 1C and 1K are electrically charged uniformly by charge rollers (charging means) 2Y, 2M, 2C and 2K, respectively, and subjected to irradiation with laser light by exposure apparatuses (exposing means) 3Y, 3M, 3C and 3K, respectively, to form thereon electrostatic latent images of corresponding colors, respectively.

The electrostatic latent images on the photosensitive drums 1Y, 1M, 1C and 1K are developed into toner (visual) images by developing apparatuses (developing means) 4Y, 4M, 4C and 4K containing toners of yellow, magenta, cyan and black, respectively. The toner image on each of the photosensitive drums (1Y, 1M, 1C and 1K) is successively primary transferred onto an intermediary transfer belt (intermediary transfer member) 5 at each of primary transfer stations (primary transfer nips) T1. The intermediary transfer belt 5 is extended around a drive roller 11, a tension roller 12, and a secondary transfer roller 13, and is rotationally driven in a direction shown by an arrow R5 by the rotation of the drive roller 11 in a direction shown by an arrow (clockwise in FIG. 1).

Residual toner particles (transfer residual toner particles) remaining on the respective photosensitive drums 1Y, 1M, 1C and 1K after the toner image transfer are removed by cleaning apparatuses (cleaning means) 7Y, 7M, 7C and 7K, respectively, and each of the photosensitive drums is subjected to a corresponding subsequent formation of toner image.

The four color toner images superposed on the intermediary transfer belt 5 are conveyed to a secondary transfer station (secondary transfer nip portion) T2 between the secondary transfer intermediary transfer 13 and a secondary transfer outer roller 14 by the movement of the intermediary transfer belt 5 in the direction of the arrow R5, and are simultaneously secondary transferred onto a transfer material P which has been supplied to the secondary transfer station T2 at a predetermined timing. The transfer material P is fed from a paper feeding cassette 15 or 16, into which sheets of the transfer material P are stacked, by paper feeding rollers 17 or 18, and is conveyed to registration rollers 19 by conveyance rollers to be supplied to the secondary transfer station T2 at the predetermined timing. The transfer material P after the toner images are transferred thereon, is heated and pressed between a fixing roller 9*a* and a pressure roller 9*b* of a fixing apparatus 9 to have a fixed toner image on its surface. As a result, a four color-based full-color toner image is formed.

To the secondary transfer outer roller 14, a predetermined bias voltage is applied from a transfer bias voltage application power supply 20 which is controlled by a control means 30. A value of current passing through the secondary transfer outer roller 14 at this time is detected by a current detection means 40, and results of the detection are fed back to a control means 30.

On the other hand, the transfer residual toner particles remaining on the intermediary transfer belt 5 after the toner image transfer are removed by an intermediary transfer member cleaner 10, and the intermediary transfer belt 5 is subjected to a next image formation.

Incidentally, the developing apparatuses 4Y, 4M, 4C and 4K are replenished with toners from toner replenishing containers 8Y, 8M, 8C and 8K, respectively.

Hereinbelow, with respect to the image forming station SY for forming a yellow toner image, structures of the respective members and image forming conditions will be described.

The developing apparatus 4Y for yellow carries a yellow toner by a toner conveyance mechanism (not shown) disposed within a developer container 41 to a developing sheet 42, and coats the yellow toner in thin layer onto the peripheral surface of the developing sleeve 42 by a regulation blade (not shown) which is pressed against the peripheral surface of the developing sleeve 42. After, an electric charge is imparted to the yellow toner, a developing bias voltage including a PC bias voltage superposed with an AC bias voltage is applied to the developing sleeve 42, whereby the yellow toner is attached and adhered to the electrostatic latent image formed on the photosensitive drum 1Y to develop the latent image as a (yellow) toner image. The developing sleeve 42 is disposed opposite to the photosensitive drum 1Y at a minute gap (300 $\mu$m) therebetween.

In this embodiment, electric potentials to be applied to the photosensitive drum 1Y, the developing sleeve 42, and the primary transfer roller 6Y are set in the following manners.

In an environment of a temperature of 23° C. and a relative humidity of 50% RH, such a control that an AC bias voltage including a DC bias voltage of −450 V biased with an AC bias voltage having a peak-to-peak voltage (Vpp) of 900 V is applied to the charge roller 2Y to electrically charge the photosensitive drum 1Y to a surface potential of −450 V.

On the other hand, to the developing sleeve 42, an AC bias voltage including a DC component of −300 V biased with an AC component having a Vpp of 1.2 kV is applied as a developing bias voltage. The AC component has a blank pulse waveform comprising an AC waveform of 9 kHz and a blank of 4.5 kHz in combination.

When the photosensitive drum 1Y is subjected to laser light exposure by the exposure apparatus 3Y, it has a light-part potential of −200 V at a point where an electrostatic latent image providing a maximum density image is to be formed.

At this time, to the primary transfer roller 6Y, an electric potential of 400 V is applied as the primary transfer bias voltage, whereby a potential difference (primary transfer contrast) between the primary transfer roller 6Y and the light-part of the photosensitive drum 1Y becomes 600 V. By the primary transfer contrast, the negatively charged toner on the photosensitive drum 1Y is transferred onto the intermediary transfer belt 5.

The intermediary transfer belt 5 comprises a 85 μm-thick base film of polyimide resin and carbon black dispersed in the resin, and is resistance-adjusted to have a surface resistivity of $1\times10^{12}$ ohm/□ and a volume resistivity of $1\times10^{9.5}$ ohm.cm. The intermediary transfer belt 5 has a peripheral length of 895 mm and is driven at a driving speed (process speed) of 130 mm/sec.

The secondary transfer outer roller 14 is formed as a sponge roller by disposing a foamed rubber layer, comprising base material of NBR (nitrile butadiene rubber) which has been subjected to foaming treatment, around a steel-made core metal (outer diameter: 12 mm) so as to have an outer diameter of 24 mm inclusive of the NBR layer. The secondary transfer outer roller 14 has been resistance controlled to have an electric resistance of $10^{7.5}$ ohm (under application of 2 kV) in an environment of 23° C. and 50% RH by dispersing an ionic conduction type resistance adjusting agent therein.

In the image forming apparatus of this embodiment, a constant-voltage bias voltage is applied as the secondary transfer bias voltage.

Figure 2:
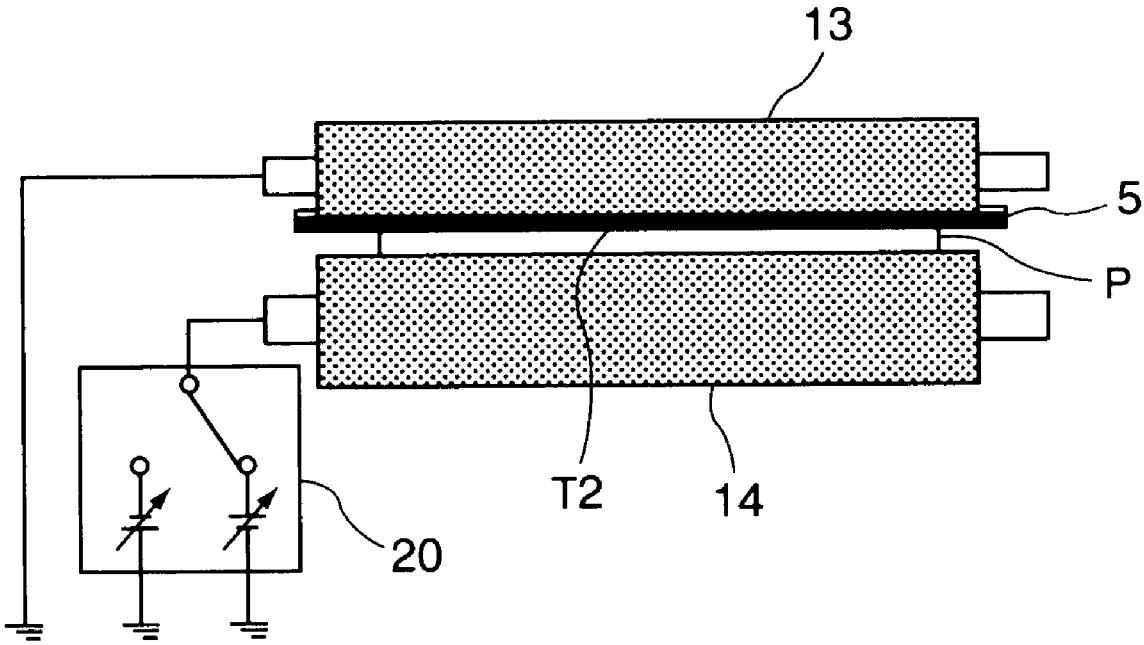
FIG. 2 is a schematic view showing a state that a transfer material having a width substantially equal to a length of secondary transfer roller pair (including a secondary transfer outer roller and a secondary transfer inner roller) is sandwiched at a secondary transfer station between the secondary transfer outer and inner rollers.
Figure 3:
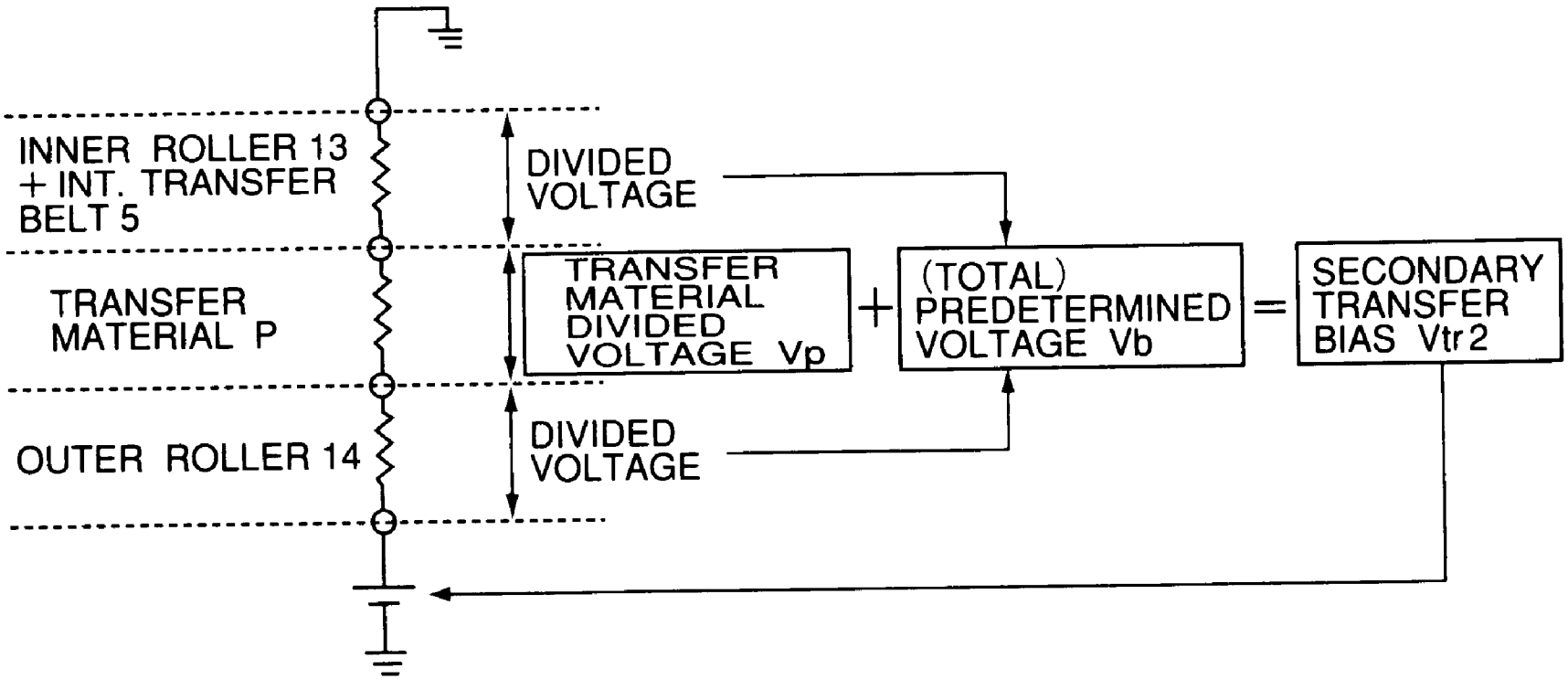
FIG. 3 is a view for illustrating a secondary transfer bias voltage to be applied to a constant-voltage power supply in Embodiment 1.

As shown in FIG. 2, assuming that the secondary transfer bias voltage is applied by the transfer bias voltage application power supply (constant voltage power supply) 20 when the (entire) width of the transfer material P which is sandwiched at the secondary transfer station T2 is substantially equal to (slightly smaller than) the width (length) of the secondary transfer roller pair (the secondary transfer inner roller 13 an the secondary transfer outer roller 14), the transfer material P is sandwiched at full width thereof, thus causing no difference (change) in resistance in its width direction. Accordingly, as shown in FIG. 3 when a secondary transfer bias voltage Vtr2 is applied, a transfer material divided voltage (a divided voltage for the transfer material P) Vp determined by subtracting a total of divided voltage of the secondary transfer inner roller 13, the intermediary transfer belt 5, and the secondary transfer outer roller 14 from the secondary transfer bias voltage Vtr2 is applied to the transfer material P. As a result, the negatively charged toner particles are attracted electrostatically to the transfer material P surface, thus being transferred onto the transfer material P.

Figure 4:
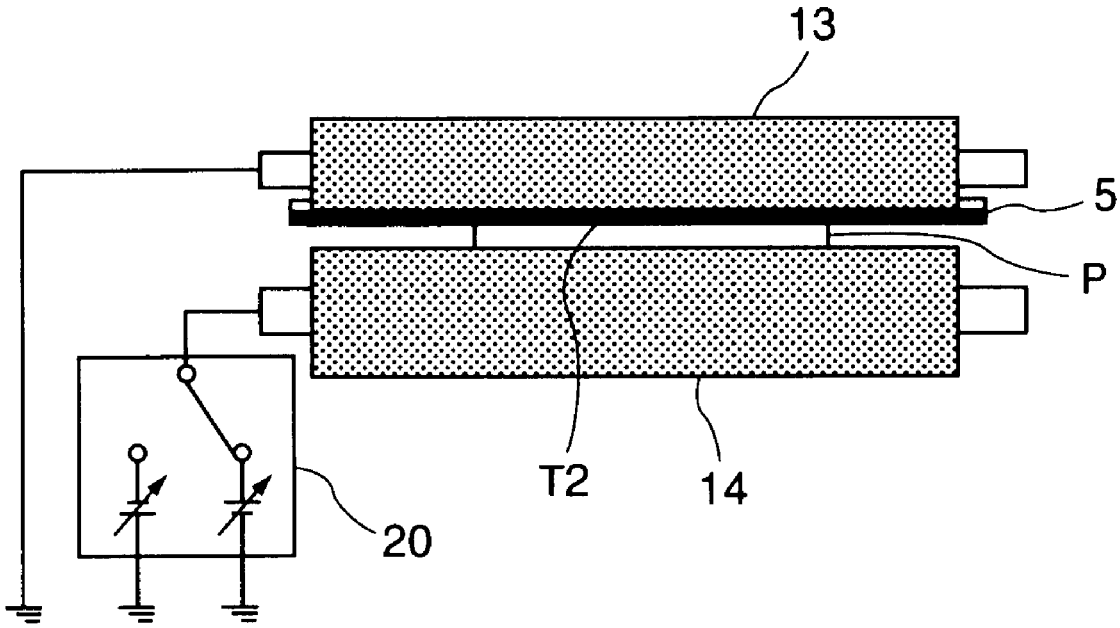
FIG. 4 is a schematic view showing a state that a transfer material having a smaller width than a length of secondary transfer roller pair is sandwiched at the secondary transfer station between the secondary transfer outer and inner rollers.

On the other hand, as shown in FIG. 4, also in the case where the width of the transfer material P is smaller than that of the secondary transfer (such as paper) is identical to that in the case of using the transfer material P having a maximum size, so that it is not necessary to change the magnitude of the secondary transfer bias voltage depending on the width of the transfer material P.

Further, in the image forming apparatus of this embodiment, as the secondary transfer outer roller 14, the above-mentioned rubber roller which has been resistance-controlled by the ion-conductive resistance adjusting agent is used, so that there is a possibility that the resultant resistance is changed depending on the change in temperature and/or humidity or with the use thereof for a long period of time.

Figure 5:
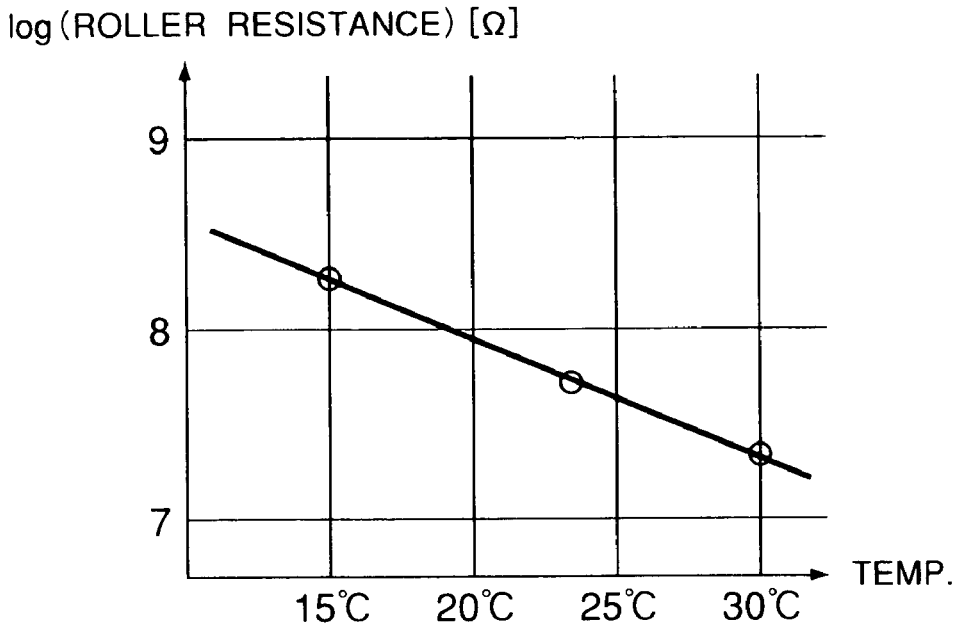
FIG. 5 is a graph showing an environmental change with temperature of an electric resistance of a secondary transfer outer roller exhibiting ionic conductivity.
Figure 6:
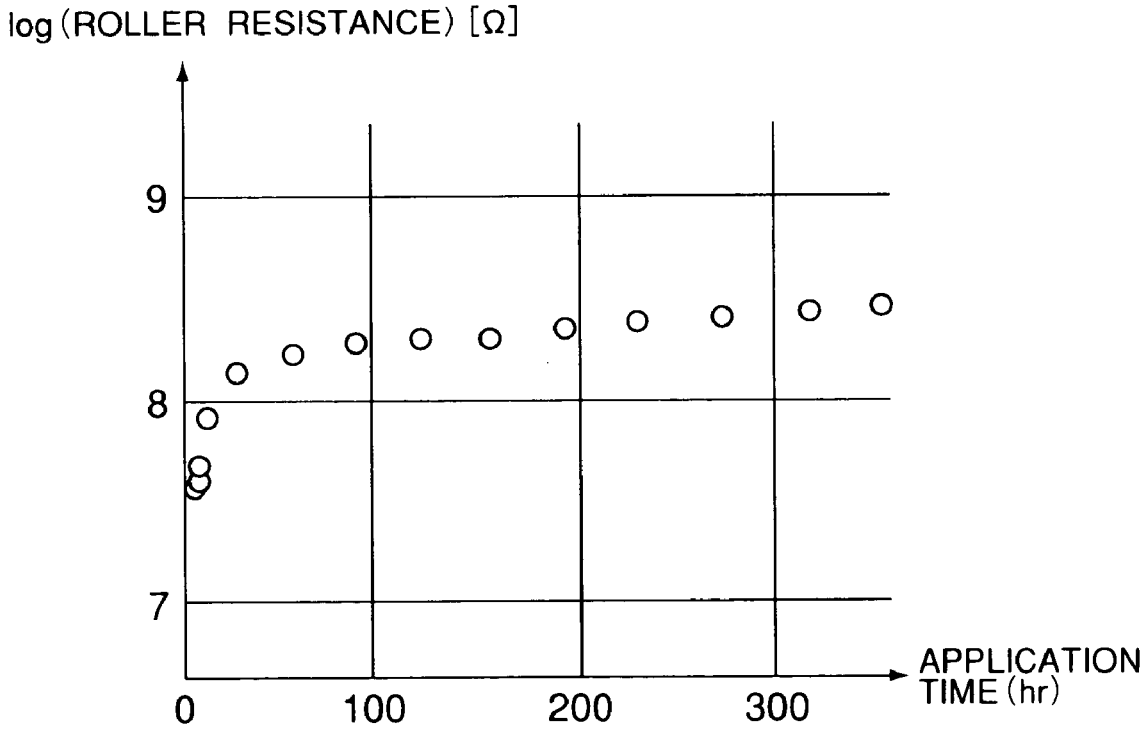
FIG. 6 is a graph showing a change with time of the electric resistance of the secondary transfer outer roller.

In the case of the ion-conductive roller, as shown in FIG. 5, the roller resistance is largely changed depending on the change in temperature. This is a phenomenon caused due to a lowering in resistivity by the increase with temperature in mobility of ions as a conductive carrier and is one of characteristics of the ion conduction. On the other hand, when the ion-conductive roller is continuously driven under application of the bias voltage, the resistance value is increased. FIG. 6 shows the progression of the resistance value of the secondary transfer outer roller 14 at the time of continuously driving rotationally the second transfer outer roller 14 at 20 rpm while applying thereto a current of 20 μA. As shown in FIG. 6, the resistance value is changed when the bias voltage is continuously applied to the ion-conductive roller.

As described above, when the change in roller resistance with temperature/humidity or the use for a long period occurs, the divided voltage of the roller is changed. Accordingly, when the constant-voltage bias voltage fixed as the secondary transfer bias voltage is applied, the transfer material divided voltage Vp is also changed, so that there is a possibility that a good transfer bias voltage setting cannot be performed stably.

Figure 7:
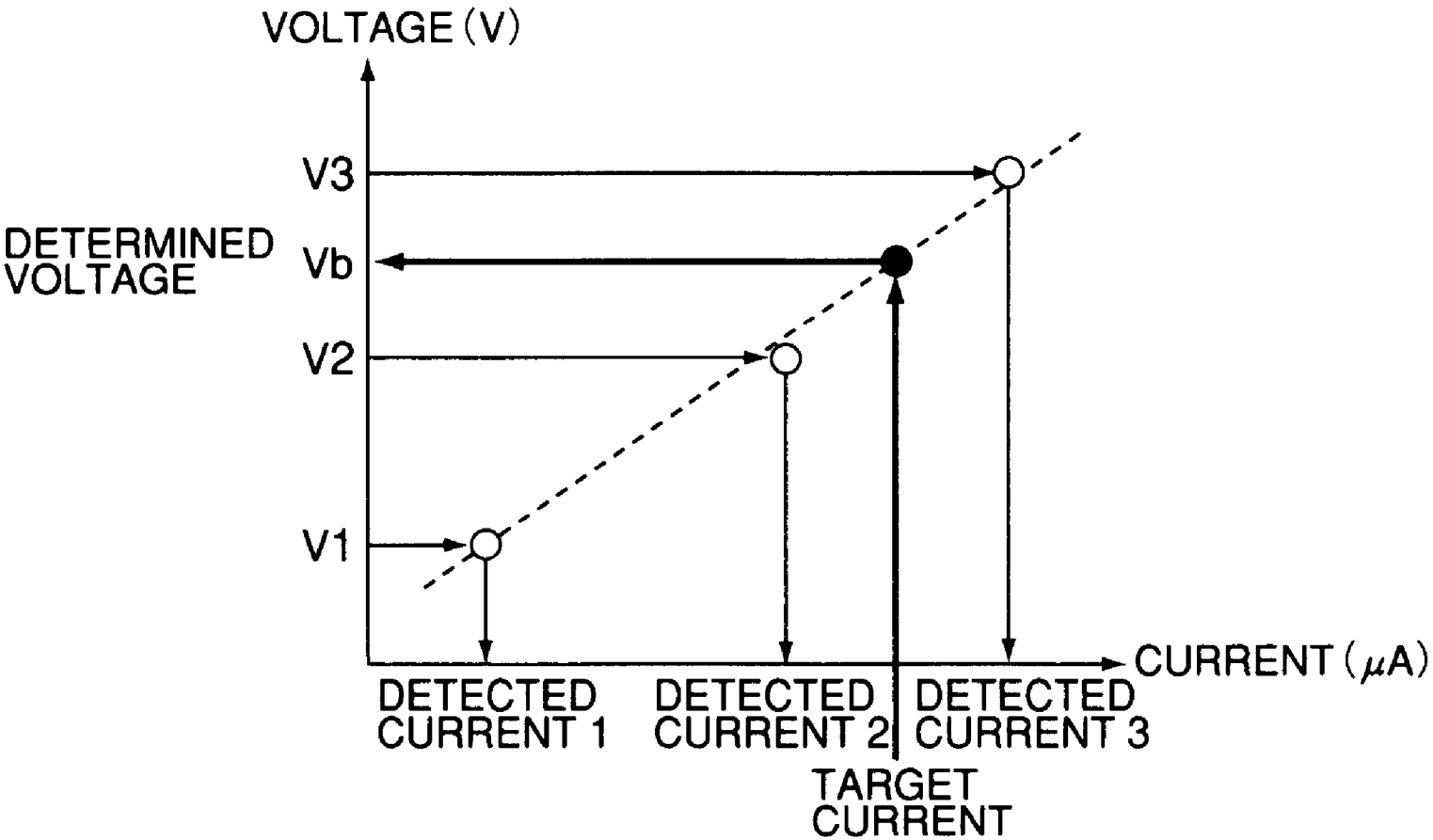
FIG. 7 is a graph for illustrating an operation of ATVC (Active Transfer Voltage Control).

In view of this possibility, in the image forming apparatus of this embodiment, by effecting the ATVC (active Transfer Voltage Control), it becomes possible to always apply a desired transfer material divided voltage. FIG. 7 shows the manner of the ATVC in the image forming apparatus of this embodiment.

Referring to FIG. 7, in the image forming apparatus of this embodiment, the ATVC is performed in such a state that the transfer material P is not sandwiched at the secondary transfer station T2. First, different constant-voltage bias voltages V1, V2 and V3 of three levels are applied, and corresponding current values are detected. These detected results are subjected to linear interpolation to obtain a linear formula, from which a constant-voltage bias voltage value providing a predetermined (required) transfer current value (target current value) is calculated to set a predetermined voltage value Vb.

The voltage value Vb refers to a secondary transfer bias voltage in the absence state of the transfer material P to be sandwiched at the secondary transfer station T2. By adding the voltage value Vb to the predetermined transfer material divided voltage value Vp, a resultant bias voltage value is set as the secondary transfer bias voltage.

In the image forming apparatus of this embodiment, as the resistance detection bias voltages in the environment of 23° C. and 50% RH, three voltages of V1=900 V<V2=1500 V, and V3=2100 V are applied, thereby to effect resistance detection. Further, when plain paper is used for transfer as the transfer material P, the target current value and the transfer material divided voltage value are set to 20 μA and 900 V respectively.

The above-mentioned ATVC is performed every time the image forming operation starts, whereby an appropriate prescribed voltage Vb can always be set.

As described above, the resistance value of the ion-conductive secondary transfer outer roller 14 varies depending on temperature/humidity or the use for a long period of time is controlled by the ATVC, so that the predetermined voltage Vp including the divided voltage of the roller is set to an appropriate value on a case-by-case basis. As a result, it becomes possible to always set an appropriate transfer bias voltage without being dependent on the changer in the roller resistance.

In the image forming apparatus of this embodiment, the secondary transfer outer roller 14 is not provided with a particular (dedicated) cleaning member, and is supplied with a reverse bias voltage, whereby the toner particles are electrostatically adhered from the secondary transfer outer roller 14 to the intermediary transfer belt 5 to effect cleaning for removing the toner particles by the intermediary transfer member cleaner 10.

Further, after the reverse bias voltage is applied at that time, the normal bias voltage is applied for a period of one full turn of the roller. This is because in the case where toner particles charged to a polarity opposite to the normal charge polarity are adhered to the intermediary transfer belt 5, the adhered toner particles are caused to be adhered to the roller, thus being liable to cause failure in complete cleaning operation.

Figure 8:
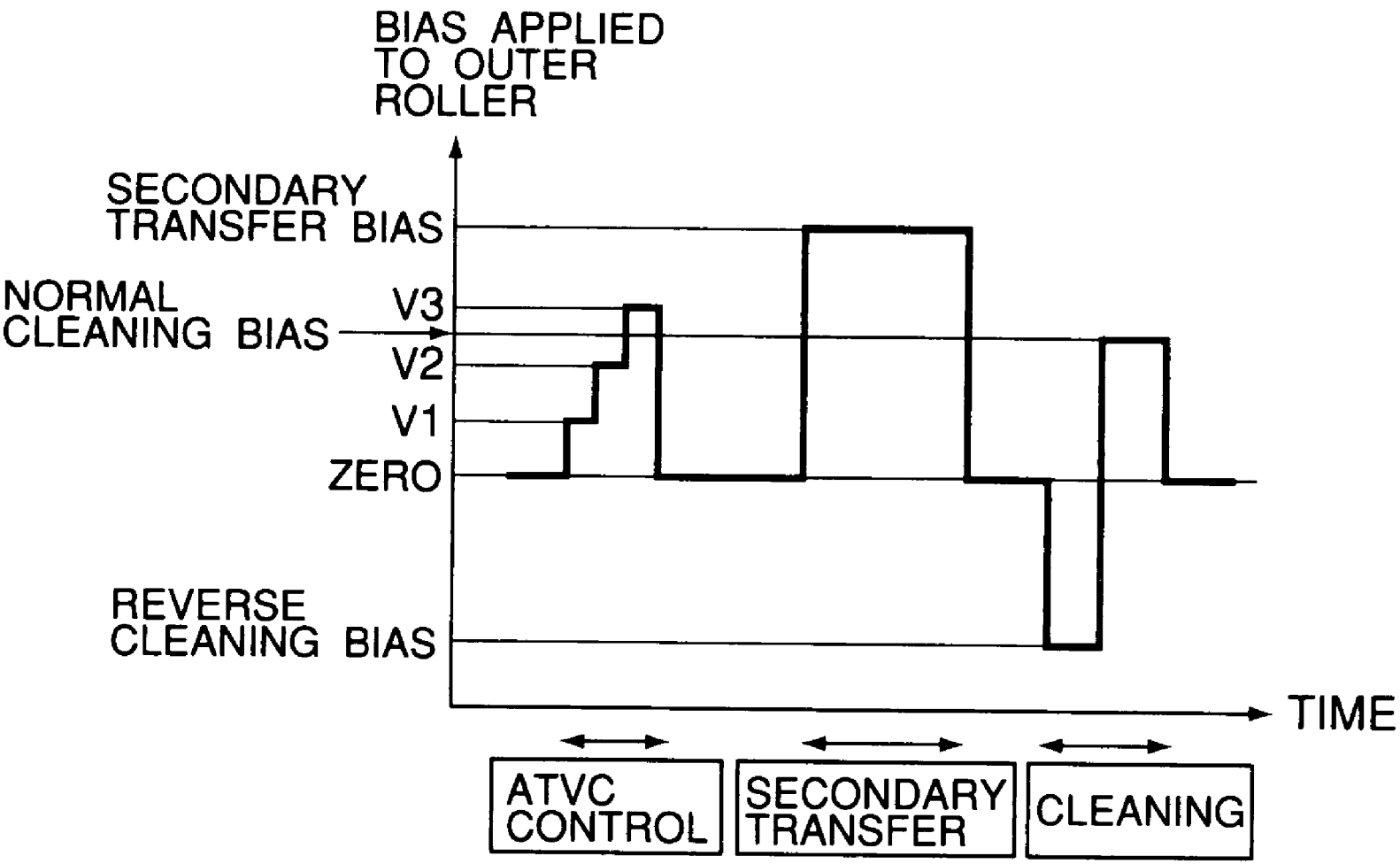
FIG. 8 is a graph for illustrating a bias voltage to be applied to the secondary transfer outer roller at the time of effecting an image forming operation with respect to only one sheet of a transfer material P.
Figure 9:
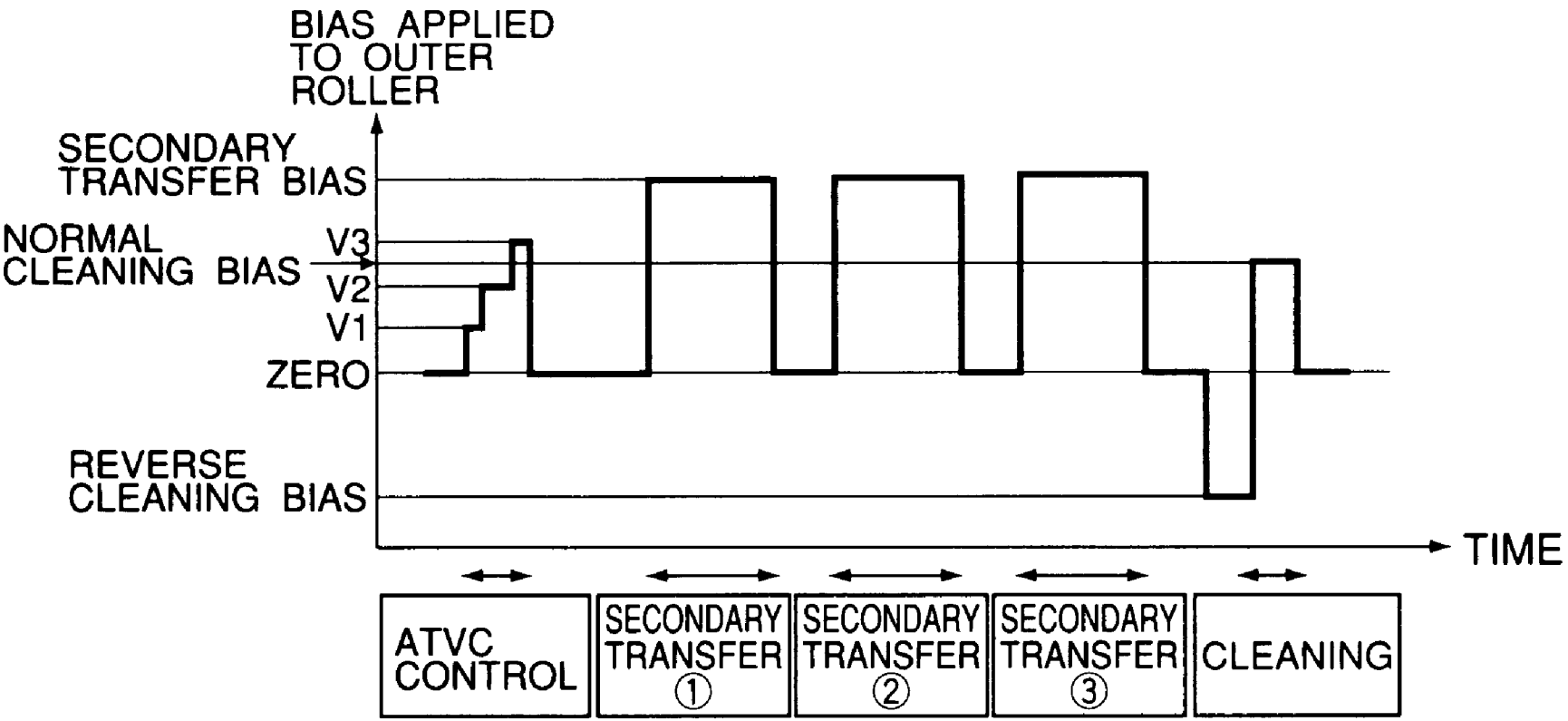
FIG. 9 is a graph for illustrating a bias voltage to be applied to the secondary transfer outer roller at the time of effecting an image forming operation with respect to a plurality of sheets of the transfer material P.

More specifically, in the image forming apparatus of this embodiment, bias voltages as shown in FIGS. 8 and 9 are applied to the secondary transfer outer roller 14 in one image forming operation. FIG. 8 shows the case of effecting secondary transfer with respect to only one sheet of the transfer material P, and FIG. 9 shows the case of effecting secondary transfer with respect to a plurality of sheets of the transfer material P. Referring to these figures, in advance of the secondary transfer, the resistance-detecting bias voltages V1, V2 and V3 for effecting the ATVC and applied, and on the other hand, a reverse cleaning bias voltage and a normal cleaning bias voltage are applied each one time after the image formation to complete the image forming operation.

The reverse cleaning bias voltage is used for removing the toner adhered to the secondary transfer outer roller 14, so that unless an appropriate bias voltage is applied, there is a possibility of the lowering in cleaning effect. This is because the electrostatic transfer of the toner, electrostatically adhered to the surface of the secondary transfer outer roller 14, onto the intermediary transfer belt 5 is performed by using a bias voltage of a polarity identical to that of the adhered toner. When a bias voltage which is excessively lower or larger than an appropriate reverse bias voltage is applied, a transfer efficiency of the adhered toner onto the intermediary transfer belt 5, i.e., a cleaning efficiency is liable to be lowered.

Figure 10:
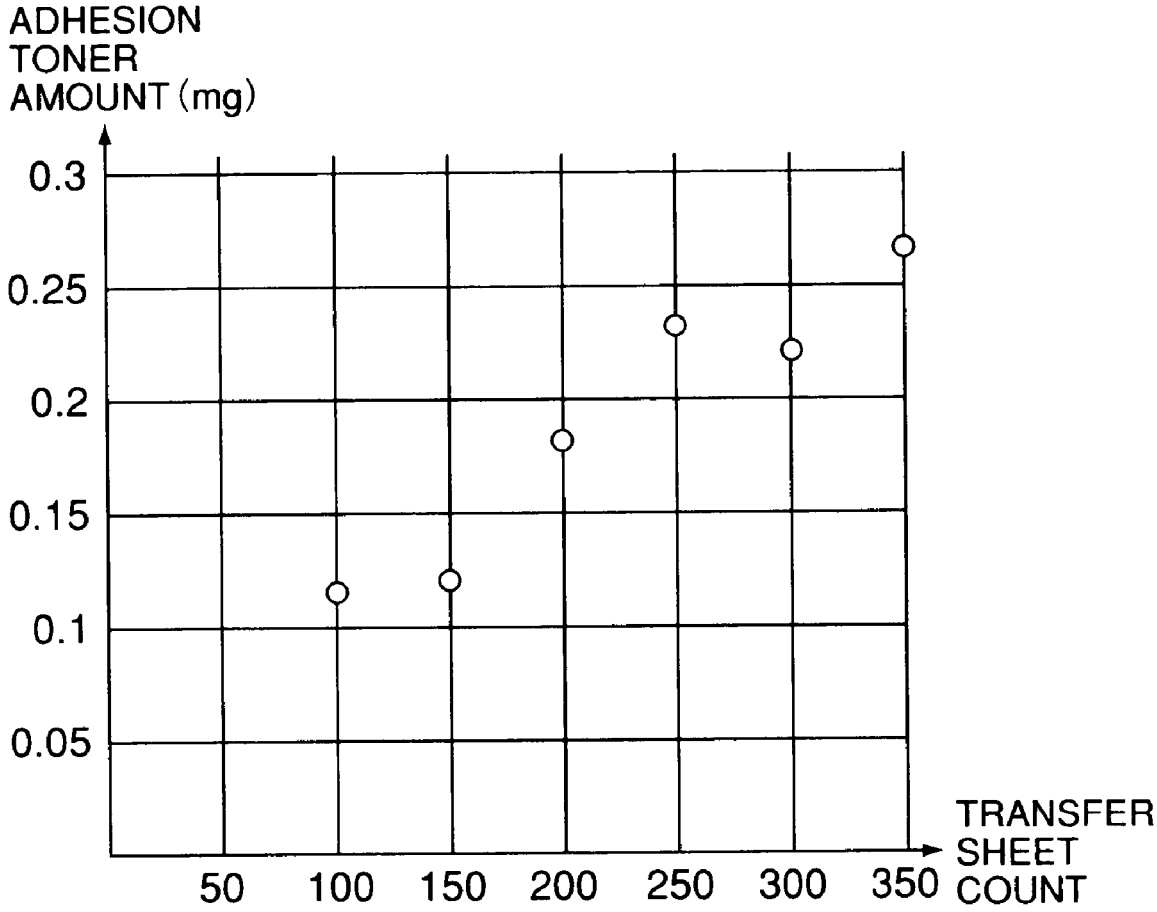
FIG. 10 is a graph showing a relationship between the number (count) of sheets of the transfer material P subjected to image formation and an amount of toner adhered to the secondary transfer outer roller.

FIG. 10 shows the progression of the amount of toner adhered to the secondary transfer outer roller 14 with the number (count) of sheets of the transfer material P subjected to the secondary transfer. As is apparent from FIG. 10, as the secondary transfer is performed with respect to a large number of sheets of the transfer material P in one image forming operation, the adhered toner amount becomes larger. This may be attributable to such a phenomenon that the drive time of the secondary transfer outer roller 14 becomes larger with the increasing number of sheets of the transfer material P to be subjected to the secondary transfer, so that much amount of toner adhered to the intermediary transfer belt 5 is transferred onto the secondary transfer outer roller 14.

As described above, even if any number of sheets of the transfer material P are secondary transferred, the cleaning bias voltage is applied only one time in one image forming operation. As the number of sheets of the transfer material P to be subjected to the secondary transfer becomes larger, the toner contamination of the secondary transfer outer roller 14 becomes worse. Accordingly, if the reverse cleaning bias voltage is appropriately set in view of this phenomenon, the resultant cleaning performance is liable to become insufficient.

On the other hand, in this embodiment, the total current amount of the normal bias voltage applied at the times of the ATVC and the secondary transfer is obtained by integration, and a reverse cleaning bias voltage is determined from the integrated value to effect appropriate cleaning.

Hereinbelow, a process for determinating the reverse cleaning bias voltage will be described with reference to FIG. 11.

Figure 11:
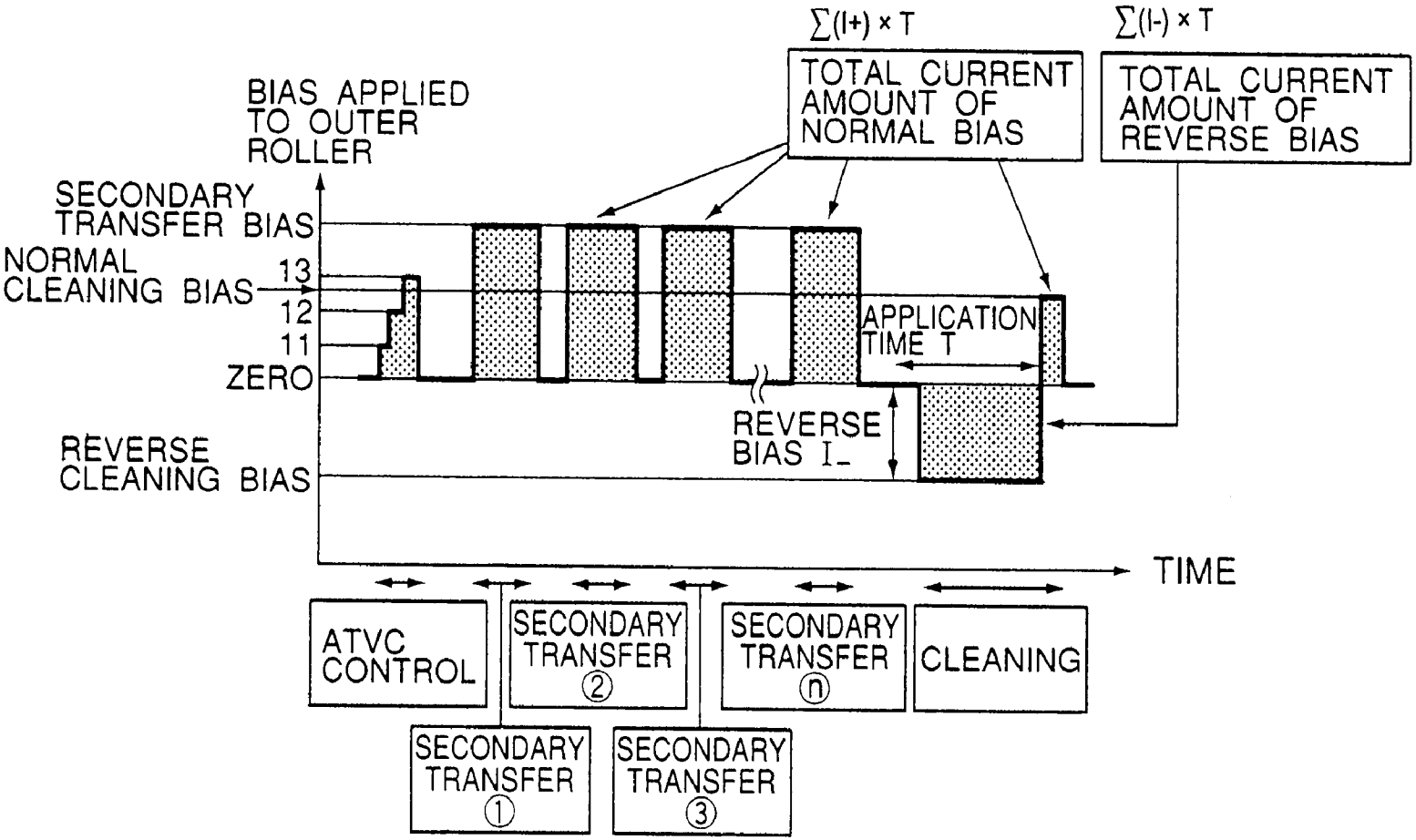
FIG. 11 is a graph for illustrating a bias voltage to be applied at the secondary transfer station.

Referring to FIG. 11, as described with reference to FIG. 10, the adhered toner amount of the secondary transfer outer roller 14 is increased with the increasing number of sheets of the transfer material P to be secondary transferred. Accordingly, the magnitude of the applied cleaning bias voltage for removing the adhered toner is also required to be increased. For this reason, integrated amounts of currents of the normal bias voltage applied at the time of the ATVC the normal bias voltage applied at the time of the secondary transfer, and the normal bias voltage applied at the time of completion of cleaning sequence are calculated by an integral current detection means (not shown). More specifically, an integral current amount $\Sigma(I+)\times T$ is determined as a total amount of electric charges by multiplying the applied current amount by the application time.

Next, the integral current amount applied as the reverse bias voltage is determined. The integral current amount of the reverse bias voltage is given by the product of an applied current amount I−multiplied by an application time T. As the integral current amount $\Sigma(E-)\times T$, a value (as an absolute value) which is not more than 25% of the integral current amount $\Sigma(I+)\times T$ of the normal bias voltage is set. Further, the applied current amount (I−) is set to be not more than −30 $\mu$A (as an absolute value) and the application time (T) is set to a period of one full turn of the roller. In this embodiment, the applied current amount (I−) is set to be not more than −30 $\mu$A in terms of an absolute value in order to prevent dielectric breakdown of the secondary transfer roller pair of the intermediary transfer belt 5.

Further, the reason why the application time is set to be the period of one full turn of the roller is because it is necessary to apply the cleaning bias voltage to at least the entire surface of the roller and it is necessary to avoid the lowering in productivity by effecting the roller cleaning for a period of plural turns of the roller. In other words, the condition is set in view of the necessity to effect an appropriate roller cleaning operation within the bounds of not impairing the productivity.

The reason why the absolute value of the integral current amount $\Sigma(I-)\times T$ is set to be not more than 25% of the absolute value of the integral current amount of the normal bias voltage $\Sigma(I-)\times T$ is because an upper limit as the amount of the reverse bias voltage for effecting appropriate cleaning is required to be set.

Figure 12:
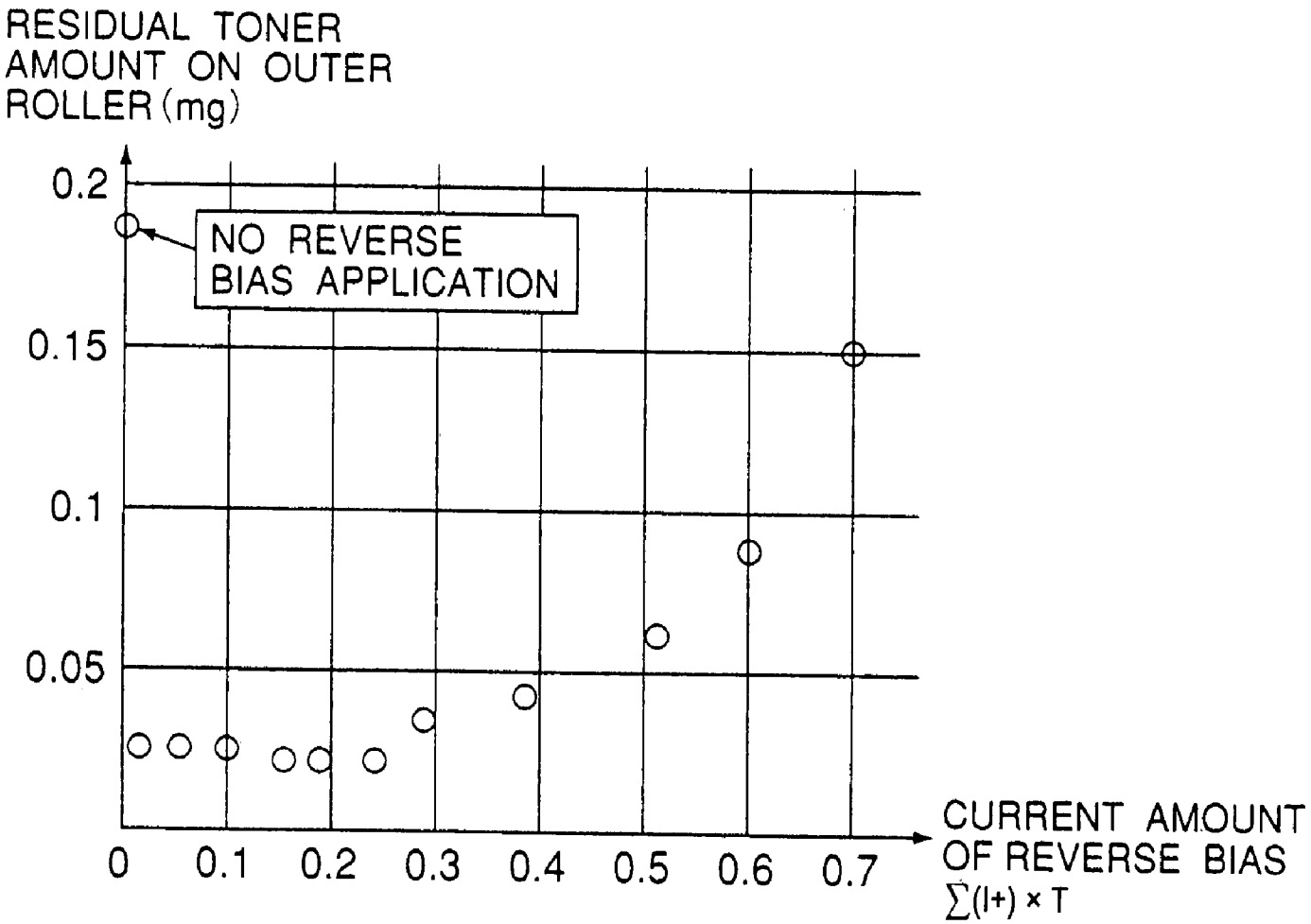
FIG. 12 is a graph showing a relationship between an amount of current of the reverse bias voltage and an amount of residual toner adhered to the secondary transfer outer roller.

FIG. 12 shows the progression of the amount of the toner which is left remaining on the secondary transfer outer roller 14 and cannot be removed therefrom (the adhered residual toner amount) after the image formation on 20 sheets of the transfer material P.

The transfer material P used at this time was a sheet (basis weight: 81.4 $m^2/g$) for a color laser copier (mfd. by Canon K.K.). Further, three normal bias voltages used at the time of the ATVC was 9.4 $\mu$A, 17.1 $\mu$A and 28.5 $\mu$A. The normal bias applied at the time of the secondary transfer was 21 pA for one sheet of the transfer material P, and the normal bias applied as the cleaning bias voltage is 28.5 $\mu$A. These normal biases applied at the time of the ATVC and as the cleaning bias voltage are applied for a period of one full turn of the roller.

More specifically, the application time (period for the ATVC and the cleaning bias is:

$$24\times3.14/130=0.58 \text{ sec.}$$

Further, the application time of the transfer bias voltage applied per one sheet (A4-sized sheet) of the transfer material P which has been fed in its lateral direction, is:

$$210/130=1.62 \text{ sec.}$$

Accordingly, the absolute value of the integral current amount of the normal bias voltages in this case is calculated as follows:

$$[(9.4+17.1+28.5)\times 0.58]+[21\times 1.62\times 20)+(28.5\times 0.58)\approx 728.8 \ (\mu C)$$

In this case, the amounts of the residual toner, which has not been removed by cleaning and remains on the secondary transfer outer roller 14 shown in FIG. 13, at the respective application times corresponding to periods of one or plural turns of the roller are values of the ordinate of the graph shown in FIG. 12.

From these results, it has been understood that it is possible to appropriately perform the cleaning of the secondary transfer outer roller 14 by applying the reverse bias voltage in an integral current amount lower than about 25% of the absolute value of the integral current amount ($\Sigma I+\Delta t$). On the other hand, in the case where the total (integral) current amount which is not less than 25% of $\Sigma I+\Delta t$ is applied as the reverse bias, the applied amount of the reverse bias becomes excessively large, so that it is considered that the transfer failure is caused to occur. Accordingly, it is necessary to set the upper limit which is less than 25% of $\Sigma I+\Delta t$.

This upper limit (<25%) is required with respect to the reverse bias voltage application cleaning at the time of effecting the image formation on 20 sheets of the transfer material P as described above but may be applicable to an image forming operation on any number of sheets of the transfer material P.

This is because the amount of the toner adhered to the secondary transfer outer roller 14 is proportional to the number of sheets of the transfer material P to be secondary transferred, so that the absolute value of the total current amount of the reverse bias voltage may be increased or decreased in proportion to the number of sheets of the transfer material P. Accordingly, in the process wherein the current amount is determined on the basis of the total current amount of the normal bias voltage which is substantially proportional to the number of sheets of the transfer material P, the above-mentioned upper limit (<25%) is also applicable to the image forming operation on any number of sheets of the transfer material P.

When the image forming operation was performed with respect to successive 20 sheets of the transfer material P as described above, it was possible to avoid the occurrence of backside contamination of the transfer material P attributable to the toner contamination of the secondary transfer outer roller 14 by applying −30 $\mu$A as the reverse bias voltage for a period of one full turn of the roller. In this case, the absolute value of the total current amount of the reverse bias voltage is 2.4% (= (30×0.58/728.8)×100) per the absolute value of the total current amount of the normal bias voltage.

If the current amount of the reverse bias voltage is determined, a constant-voltage bias voltage to be applied is determined from the current-voltage (I–V) characteristic of the secondary transfer station T2 obtained by the ATVC. In this embodiment, the constant-current bias voltage value was −2224 V.

Similarly, a process for determinating an applied current amount of the reverse bias voltage at the time of effecting the image formation with respect to one sheet of the transfer material will be explained.

Three voltages applied by the ATVC were V1= 900 V, V2=1500 V and V3=2100 V, detected current values at this time were 4.2 $\mu$A, 8.9 $\mu$A and 14.2 $\mu$A, respectively. A total current amount of the normal bias voltages at this time was about 58.0 ($\mu$C). Accordingly, the upper limit of the total charge amount of the reverse bias voltage is about 14.5 ($\mu$C). The reverse bias is applied for a period of one full turn of the roller, so that the upper limit of the current amount of the reverse bias voltage is about 25 ($\mu$A). Accordingly, the current value to be applied as the reverse bias voltage. In this case, the total current amount of the reverse bias voltage is 24.5% of the total current amount of the normal bias voltages. Further, in this case, the reverse bias voltage is −3346 V which is determined from the results of the ATVC.

In the case of successive image formation, the frequency of the cleaning operation with the reverse bias voltage is lowered, so that such a problem that contaminant is accumulated on the transfer roller arises. Accordingly, the ratio of the reverse bias voltage is required to be kept at a value which is not less than a certain value.

The inventors have conducted a study as to whether the contamination problem arises when the number of sheets of the transfer material P is increased to what extent under such a condition that the cleaning operation with the reverse bias voltage is performed for a period of one full turn of the transfer roller after the completion of successive image formation, e.g., it has been found that the contamination problem arises when the number of sheets of the transfer material P exceeds 250 sheets.

The absolute value of the integral current amount of the normal bias voltage at the time of the number of fed sheets of the transfer material P is:

$$(9.4+17.1+28.5)\times 0.58+(21\times 1.62\times 250)+28.5\times 0.58\approx 8553.4.$$

On the other hand, the absolute value of the integral current amount of the reverse bias voltage is:

$$30\times 0.58=17.4.$$

In this case, the ratio of the absolute value of the total current amount of the reverse bias voltage to that of the normal bias voltage is:

$$(17.4/8553.4)\times 100\approx 0.20\%.$$

Accordingly, if the ratio of not less than 0.20% is ensured, it is possible to effectively prevent the adhesion of contaminant to the transfer roller.

As described above, the current value of the reverse bias voltage is determined with reference to the absolute value of the total current amount of the normal bias voltage. More specifically, the current value of the reverse bias voltage is determined under three conditions that it is in the range of not less than 0.20% and less than 25%, that the reverse bias voltage is applied for a period of one full turn of the roller, and that the absolute value of the current amount of the reverse bias voltage does not exceed 30 $\mu$A. Further, in vie of the I–V characteristic obtained by the ATVC at the time of image formation, a constant-voltage bias voltage value is determined from the current amount of the reverse bias voltage which has been determined through the above-described process.

By setting the applied amount of the reverse cleaning bias voltage as described above, there is no occurrence of the toner contamination on the backside of the transfer material P.

According to this embodiment, it is possible to appropriately avoid the toner contamination of the secondary transfer outer roller 14 by applying the reverse cleaning bias voltage determined through the above-mentioned process, so that it becomes possible to provide an image forming apparatus free from the problem of the backside contamination of the transfer material P.

<Embodiment 2>

An image forming apparatus of this embodiment has a general structure identical to that of the image forming apparatus of Embodiment 1 shown in FIG. 1. In Embodiment 1, the bias voltages were controlled so that as the bias voltages applied to the secondary transfer outer roller 14, bias voltages including the bias voltage for the ATVC, the secondary transfer bias voltages, the normal cleaning bias voltage, and the reverse cleaning bias voltage are applied, and that a higher voltage is not applied.

Figure 14:
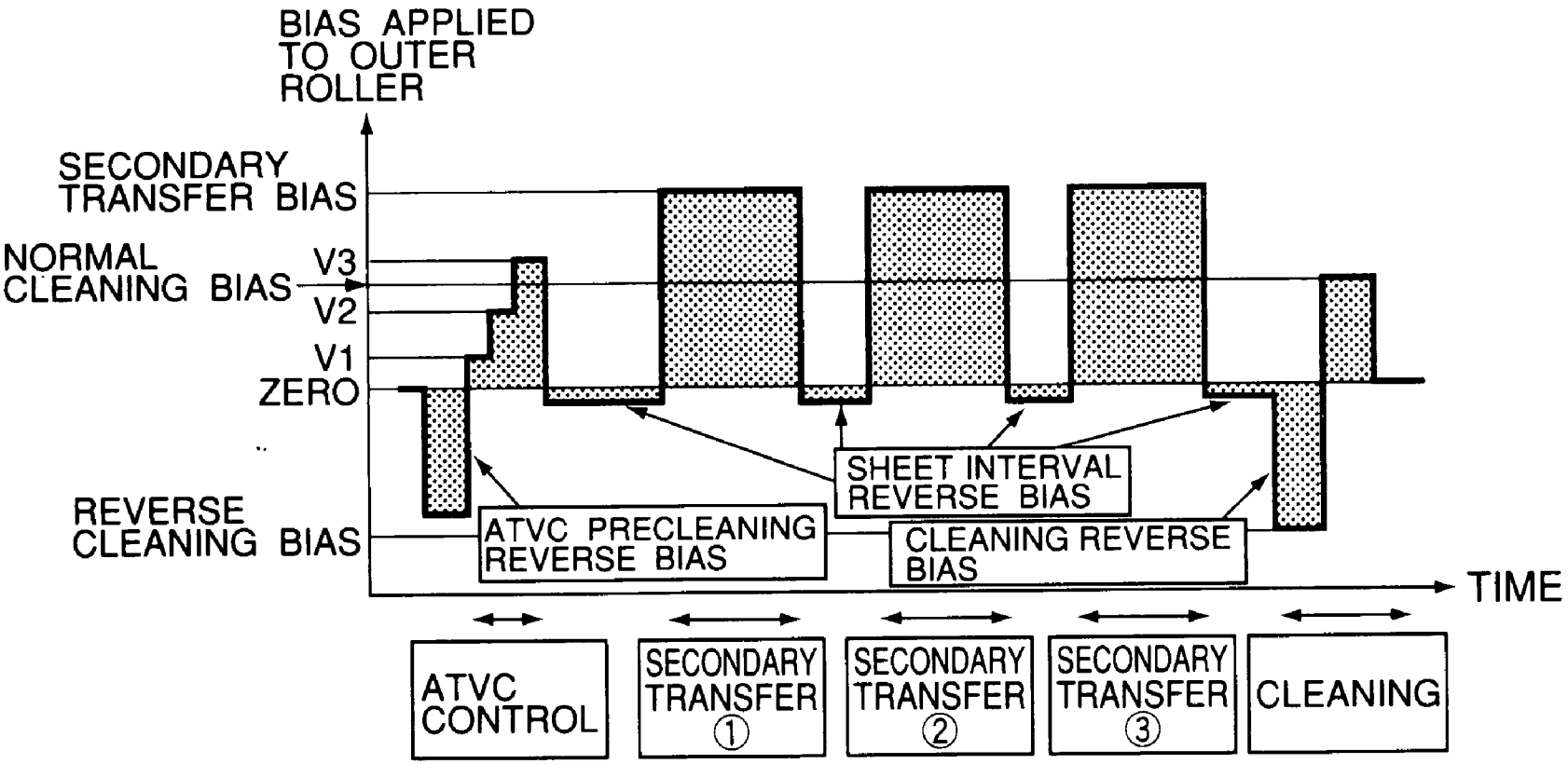
FIGS. 14, 15, 16 and 17 are respectively a graph for illustrating a bias voltage to be applied at the secondary transfer station in Embodiments 2, 3, 4 and 5, respectively.

On the other hand, in the image forming apparatus of this embodiment, a higher voltage control as shown in FIG. 14 is performed in order to prevent the toner transfer and adhesion from the intermediary transfer belt 5 with reliability.

More specifically, reverse bias voltages are applied for periods of immediately before the ATVC, between the ATVC and a secondary transfer, between adjacent secondary transfers, between subsequent adjacent secondary transfers, and between the last secondary transfer and the reverse cleaning bias voltage application, respectively.

All these bias voltages are reverse bias voltages to be applied for preventing unintended toner transfer and adhesion.

The reverse bias voltage applied immediately before the ATVC is applied to obviate the toner contamination with more reliability by removing the toner contamination in advance to the ATVC so as to allow more accurate grasping of the I–V characteristic at the secondary transfer station T2. Further, the reverse bias voltages applied, from after the ATVC to before application of the reverse cleaning bias voltage, at timings of not applying the secondary transfer bias voltages (hereinafter, referred to as "sheet interval reverse bias voltage(s)" are used or preventing the toner from being transferred and adhered, at the timing of secondary transfer bias voltage application, to the backside of the transfer material P.

Also in the image forming apparatus of this embodiment, the reverse bias voltages are set by reference to the integral current amount of the normal bias voltages so that their integral current amount is not less than 25% of that of the normal bias voltages. More specifically, as the precleaning bias voltage is advance of the ATVC, a reverse bias voltage of −2 KV is applied for a period of one full turn of the secondary transfer outer roller 14 in an environment of 23° C. (temperature) and 50% RH (relative humidity), and a current value at that time is detected. Further, as the sheet interval reverse bias voltages, a bias voltage of −50 V is applied, and a current value at that time is also detected.

In this embodiment, the normal bias voltages for the ATVC and the secondary transfers are determined in the same manner as in Embodiment 1. As the normal cleaning bias voltage, the third constant-voltage bias voltage V3 applied at the time of the ATVC is used.

With respect to the reverse cleaning bias voltage, the absolute value of the interval current amount of the reverse bias voltage is determined by reference to the integral current amount of the normal bias voltage so that it is not less than 25%, and a maximum current amount within the range is applied.

In this embodiment, the environment of 23° C. and 50% RH, image formation on 20 sheets of color laser copier paper (A4-size) as the transfer material P was performed. For the ATVC, three stepwise normal bias voltages of V1=900 V, V2=1500 V and V3=2100 V were applied, and ATVC detection current value at that time were 9.1 μA, 14.3 μA and 20.1 μA, respectively. Further, the detection current at the time of applying a reverse bias voltage of −2 KV as the ATVC precleaning bias voltage was −19.3 μA, that at the time of applying a reverse bias voltage of −50 V as the sheet interval reverse bias voltage was −0.1 μA, and that at the time of applying the secondary transfer bias voltage was 21.8 μA. Further, the ATVC precleaning bias voltage was applied for a period of one full turn of the roller, i.e., for 0.58 sec., similarly as in the case of the ATVC. On the other hand, the sheet interval reverse bias voltages were applied or 2 sec. between the completion of the ATVC and the secondary transfer for the first transfer material P; for 0.26 sec. between the secondary transfers for adjacent two transfer materials P; and for 1 sec. between the completion of the secondary transfer for the last transfer material P.

In this case, the absolute value of the integral current amount of the normal bias voltages is:

$$(9.1+14.3+20.1)\times 0.58+(21.8\times 20\times 1.62)\approx 731.6\ (\mu C).$$

On the other hand, the absolute value of the integral current amount of the applied reverse bias voltages except for the reverse cleaning bias voltage is:

$$(19.3\times 0.58)+0.1\times(2+(0.26\times 19)+1)=11.988\ (\mu C).$$

Accordingly, since the upper limit of the absolute value of the current amount of all the reverse bias voltages is:

$$731.6\times 0.25=182.9\ (\mu C),$$

the upper limit of the absolute value of the current amount of the reverse cleaning bias voltage alone is:

$$182.9-11.988=170.9\ (\mu C).$$

Accordingly, the upper limit of the absolute value of the applied current amount of the reverse cleaning bias voltage is:

$$170.9/0.58\approx 294.7\ (\mu A).$$

For this reason, in this embodiment, the reverse cleaning bias voltage is set to apply −30 μA as the current amount and −3132 V as the constant-voltage bias voltage by reference to the I–V characteristic of the ATVC. In this embodiment, the absolute value of the integral current amount of the reverse bias voltages is 4.0% of the integral current amount of the normal bias voltages.

According to this embodiment, the cleaning bias voltages are set as described above, whereby there is no occurrence of the toner contamination on the backside of the transfer material P.

Also in this image forming apparatus of this embodiment, by setting the bias voltages as described above, it is possible to well remove the toner contamination of the secondary transfer outer roller 14, and the backside contamination of the transfer material P can effectively be prevented.

<Embodiment 3>

An image forming apparatus of this embodiment has a general structure identical to that of the image forming apparatus of Embodiment 1 shown in FIG. 1. In Embodiments 1 and 2, the constant-voltage bias voltages are applied as the bias voltages to be applied to the secondary transfer outer roller 14, but in the image forming apparatus of this embodiment, constant-current bias voltages are applied.

Figure 15:
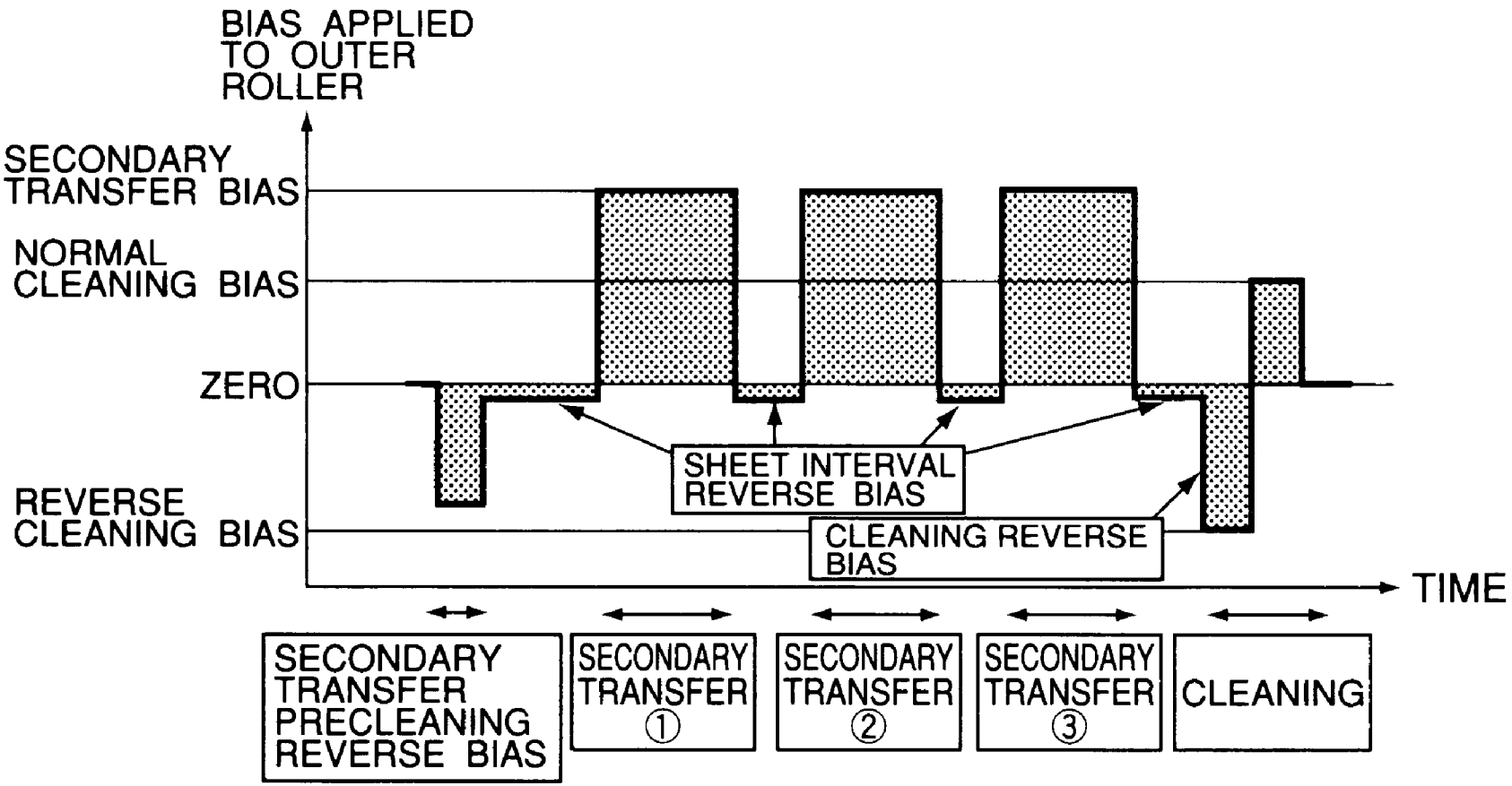

In the image forming apparatus of this embodiment, there is no need to perform the ATVC, so that bias voltages to be applied to the secondary transfer outer roller 14 is as shown in FIG. 15. More specifically, before secondary transfer operations, a secondary transfer precleaning bias voltage is applied, and after the secondary transfer operations, a secondary transfer precleaning bias voltage is applied, and after the secondary transfer operations, a reverse cleaning bias voltage and a normal cleaning bias voltage are applied in the form of a constant-current bias voltage.

In the image forming apparatus of this embodiment, as the secondary transfer bias voltages for plain paper such as color laser copier paper, a current amount of 20 $\mu$A is applied in an environment of 23° C. and 5% RH. Further, a current amount of −10 $\mu$A is applied as the secondary transfer precleaning bias voltage, and a current amount of −0.3 $\mu$A is applied as sheet interval bias voltages.

In this embodiment, at the time of performing image formation on one sheet of A4-size color laser copier paper, an absolute value of an integral current amount of the normal bias voltages applied is:

$$20\times1.62\times1=32.4\ (\mu C).$$

On the other hand, an absolute value of an integral current amount of the sheet interval bias voltages applied and the secondary transfer precleaning bias voltage applied is:

$$10\times0.58+0.3\times(2+1)=6.7\ (\mu C).$$

A maximum of the integral current amount capable of being applied by the reverse cleaning bias voltage is:

$$32.4\times0.25-6.7=1.4\ (\mu C).$$

Accordingly, as the reverse cleaning bias voltage, $$1.4/0.58\approx2.4\ (\mu A)$$

is set to be applied to the secondary transfer outer roller 14 for a period of one full turn of the roller 14. In this case, there is also no occurrence of the toner contamination on the backside of the transfer material P.

According to this embodiment, by setting the current amount of the reverse cleaning bias voltage as described above, it is possible to provide an image forming apparatus capable of effectively obviate the backside contamination of the transfer material P attributable to the toner contamination of the secondary transfer outer roller 14 even at the secondary transfer station T2 where the constant-current control is performed.

<Embodiment 4>

Figure 16:
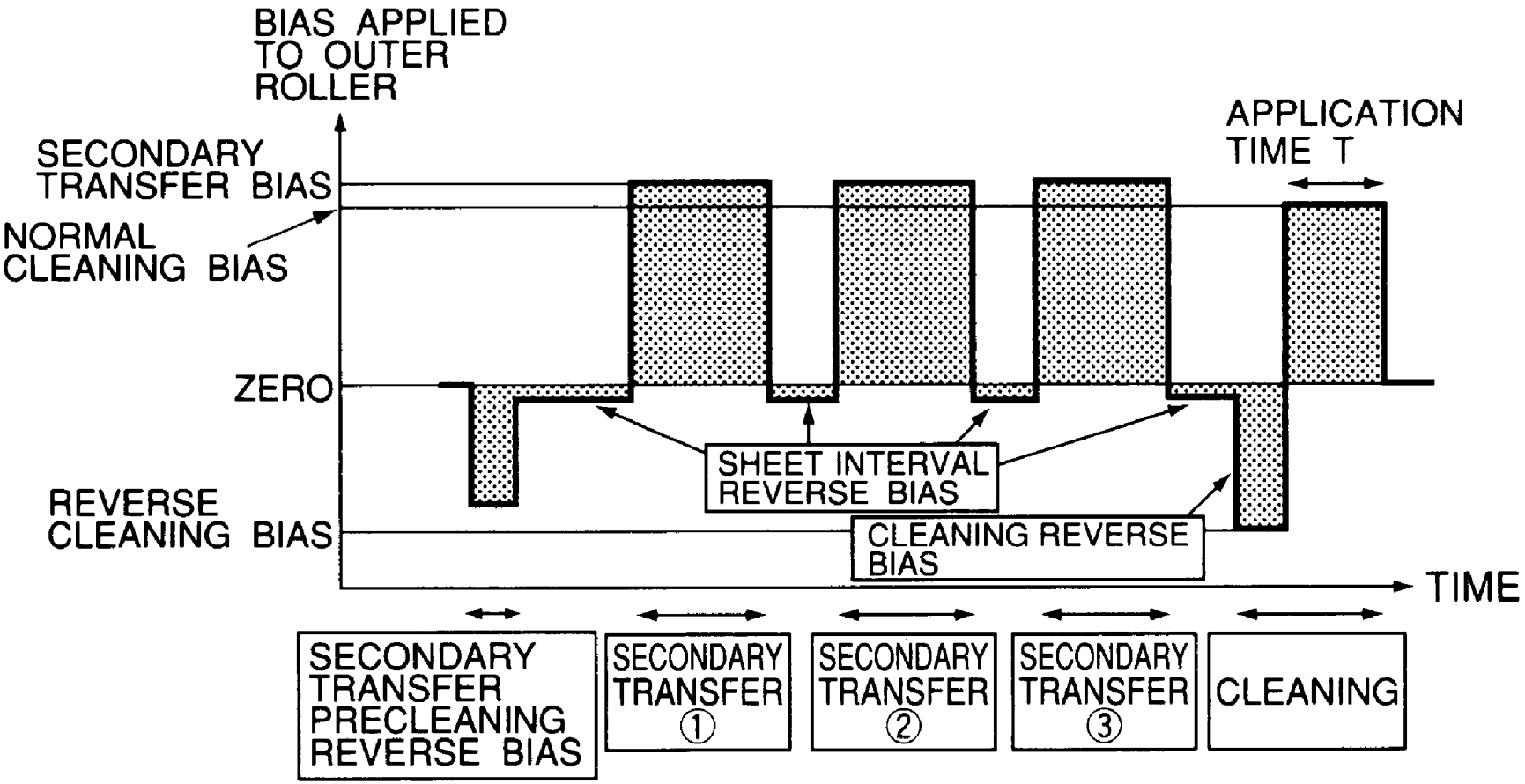
Figure 17:
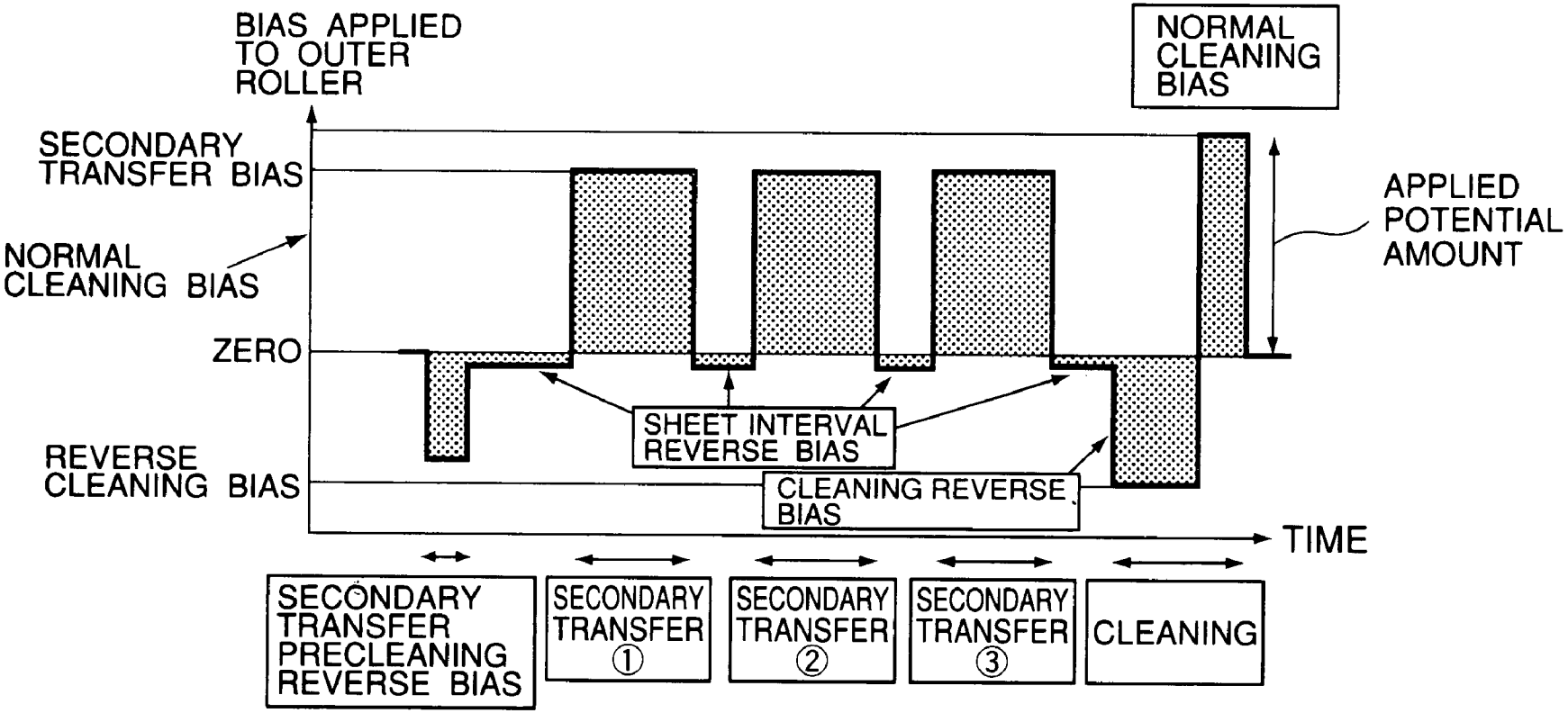
Figure 18:
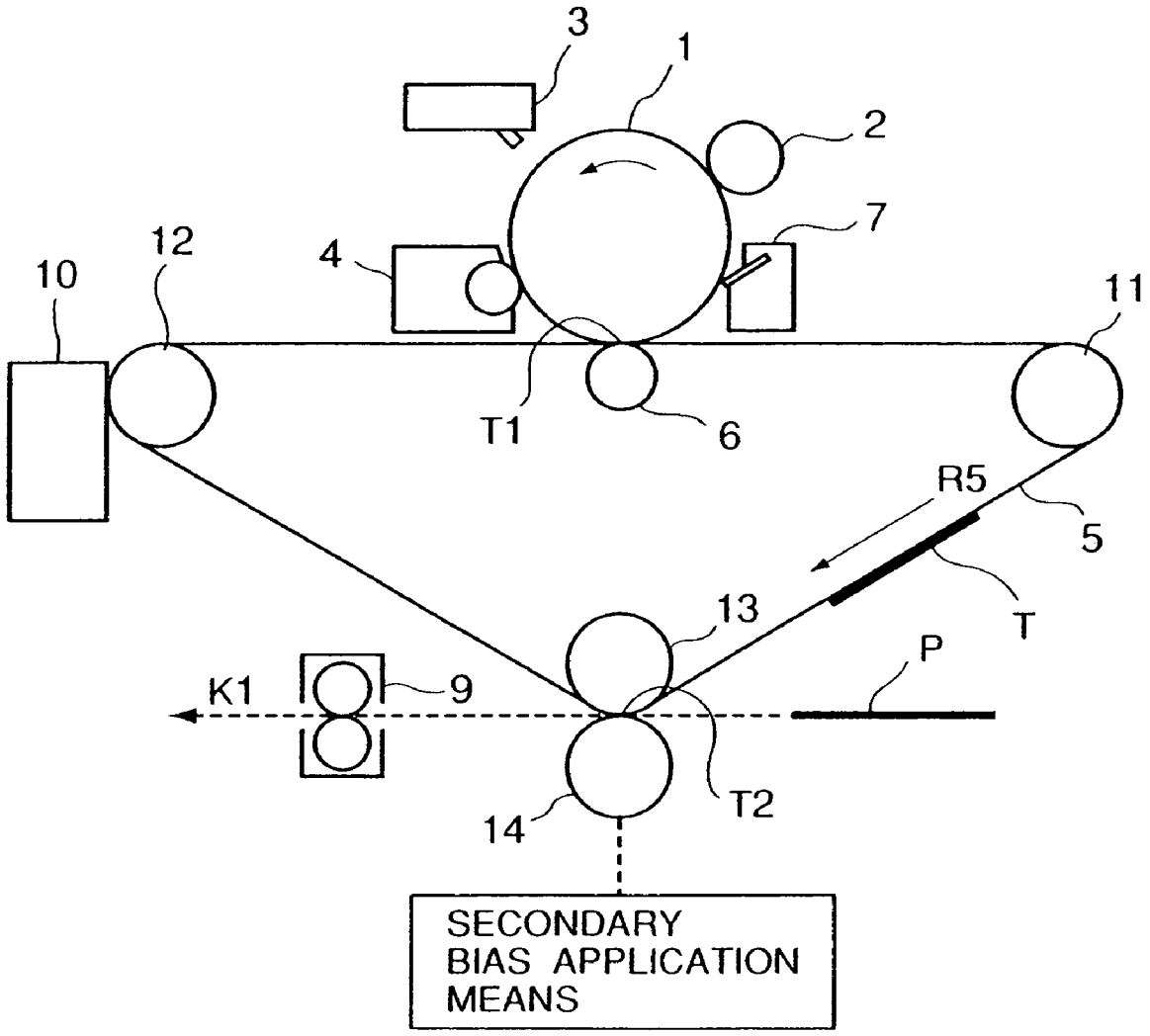
FIG. 18 PRIOR ART
FIG. 18 is a schematic cross-sectional view of a general structure of a conventional image forming apparatus.

An image forming apparatus of this embodiment has a general structure identical to that of the image forming apparatus of Embodiment 1 shown in FIG. 1. In Embodiments 1, 2 and 3, the current amount and application time of only the reverse cleaning bias voltage of the cleaning bias voltages are adjusted, but in the image forming apparatus of this embodiment, the variable control of the application time is also performed with respect to the normal cleaning bias voltage, as shown in FIG. 16.

In the image forming apparatus of this embodiment, removal of toner particles charged to a polarity opposite to the normal charge polarity by applying the normal cleaning bias voltage. In such a case where the toner particles which have been electrically charged to the opposite polarity to the normal charge polarity, the toner particles are also adhered to the secondary transfer outer roller 14 even at the time of applying the sheet interval reverse bias voltages as shown in FIG. 16, so that it is also necessary to apply an appropriate bias voltage a the normal cleaning bias voltage.

In this embodiment, the normal cleaning bias voltage is adjusted within the range wherein the integral current amount of the revere bias voltages is less than 25% of the integral current amount of the normal bias voltages.

In the image forming apparatus of this embodiment, as the secondary transfer bias voltages for plain paper such as color laser copier paper, a current amount of 20 $\mu$A is applied in an environment of 23° C. and 5% RH. Further, a current amount of −10 $\mu$A is applied as the secondary transfer precleaning bias voltage, and a current amount of −0.3 $\mu$A is applied as sheet interval bias voltages.

In this embodiment, at the time of performing image formation on 30 sheets of A4-size color laser copier paper, an absolute value of an integral current amount of the normal bias voltages applied is:

$$20\times1.62\times30=972\ (\mu C).$$

On the other hand, an absolute value of an integral current amount of the sheet interval bias voltages applied and the secondary transfer precleaning bias voltage applied is:

$$10\times0.58+0.3\times31=15.1\ (\mu C).$$

In this embodiment, as the normal cleaning bias voltage, a current amount of 10 $\mu$A is applied and an application time thereof is variable-controlled. More specifically, the current amount of 10 $\mu$A is applied, as the normal cleaning bias voltage, for a period of N turns of the roller while a current amount Z ($\mu$A) is applied, as the reverse cleaning bias voltage, for a period of one full turn of the roller. N is an integer which does not exceed 3. In other words, in order to lower the productivity more than necessary, the normal bias cleaning is not performed for a period of more than 3 turns of the roller. On the other hand, the upper limit of the reverse cleaning bias voltage is set to satisfy $Z\leqq30$ ($\mu$A) (as absolute value).

Under the above conditions, combinations of Z and N satisfying the following inequality:

$$15.1+Z\times0.58<0.25\times(972+10\times N)$$

are selected, and from the selected combinations, such a combination that both Z and N become maximum is adopted in this embodiment.

More specifically, the combination of Z=30 and N=3 is employed in this embodiment. The current amount of 30 $\mu$A (absolute value) for the reverse cleaning bias voltage is applied for the period of one full turn of the roller, and the current amount of 10 $\mu$A for the normal cleaning bias voltage is applied for the period of three turns of the roller. In this case, there is no occurrence of the toner contamination on the backside of the transfer material P.

According to this embodiment, by setting the applied current amounts and application times of both the normal and reverse cleaning bias voltage as described above, it is possible to provide an image forming apparatus capable of effectively obviate the backside contamination of the transfer material P attributable to the toner contamination of the secondary transfer outer roller 14.

<Embodiment 5>

An image forming apparatus of this embodiment has a general structure identical to that of the image forming apparatus of Embodiment 1 shown in FIG. 1. In Embodiment 4, the variable control of the application time of the normal cleaning bias voltage of the cleaning bias voltages is performed, but in the image forming apparatus of this embodiment, variable control of applied current amount is performed with respect to the normal cleaning bias voltage.

In the image forming apparatus of this embodiment, the normal cleaning bias voltage is applied for only a period of one full turn of the roller, but the applied current amount thereof is variable-controlled while setting an upper limit of 30 $\mu$A. Further, the integral current amount of the reverse bias voltages is set to be less than 25% of that of the normal bias voltages, whereby it is possible to effect cleaning, with reliability, of the toner charged to a polarity opposite to the normal charge polarity.

In Embodiments 1–5, the intermediary transfer belt (intermediary transfer member) 5 is used as the image bearing member but an intermediary transfer drum (drum-shaped intermediary transfer member) is also applicable in place of the intermediary transfer belt 5 and can achieve the similar effects.

Further, in Embodiments 1–5, the transfer process is performed from the intermediary transfer member as the image bearing member onto the transfer material P but may also be performed from the photosensitive drum as the image bearing member onto the transfer material P. In this case, the similar effects can also be attained.

What is claimed is:

1. An image forming apparatus, comprising:

image forming means for forming a toner image on an image bearing member;

a transfer member for transferring the toner image from the image bearing member onto a transfer material by being supplied with a bias voltage;

bias voltage application means for applying a normal bias voltage of a polarity opposite to a polarity of a toner or a reverse bias voltage opposite in polarity to the normal bias voltage;

control means for controlling said bias voltage application means; and integral current detection means for detecting an integral of an amount of a current flowing from said bias voltage application means to said transfer member, wherein said integral current detection means is capable of detecting an integral current amount of the normal bias voltage at the time of applying the normal bias voltage and an integral current amount of the reverse bias voltage at the time of applying the reverse bias voltage, and said control means controls said bias voltage application means so that an absolute value of the integral current amount of the reverse bias voltage is in the range of not less than 0.2% and less than 25% of an absolute value of the integral current amount of the normal bias voltage.

2. An apparatus according to claim 1, wherein said control means controls said bias voltage application means during a period from start to completion of a cycle of an image forming operation.

3. An apparatus according to claim 1, wherein said transfer member is in a form of a roller, and said control means applies the reverse bias voltage for not less than a period of one full turn of said transfer member.

4. An apparatus according to claim 1, wherein said control means controls so that the absolute value of the current at the time of applying the reverse bias voltage is not more than a predetermined upper limit.

5. An apparatus according to claim 1, wherein the predetermined upper limit is 30 $\mu$A.

6. An apparatus according to claim 1, wherein said bias voltage application means effects constant voltage control.

7. An apparatus according to claim 1, wherein said bias voltage application means effects constant current control.

8. An apparatus according to claim 6, wherein said control means detects a voltage-current characteristic at a transfer station is a state that the transfer member is not present, and determines a voltage value of said reverse bias voltage on the basis of the detected voltage-current characteristic.

* * * * *

UNITED STATES PATENT AND TRADEMARK OFFICE

CERTIFICATE OF CORRECTION

PATENT NO. : 6,990,300 B2
APPLICATION NO. : 10/671690
DATED : January 24, 2006
INVENTOR(S) : Makoto Saito et al.

It is certified that error appears in the above-identified patent and that said Letters Patent is hereby corrected as shown below:

Title page,
Item [56], References Cited, FOREIGN PATENT DOCUMENTS,
"03233484 A" should read -- 3-233484 A --; and
"06067517 A" should read -- 6-67517 A --.

Column 1,
Line 30, "primary" should read -- primarily --;
Line 31, "an" should read -- a --;
Line 32, "an" should read -- and --; and "secondary" should read -- secondarily --; and
Line 60, "of and increase in" should read -- and increase the --.

Column 2,
Line 24, "to be" should read -- are --.

Column 3,
Line 1, "voltage" should read -- voltage is --.

Column 7,
Line 41, "is" should read -- are --.

Column 8,
Line 58, "changer" should read -- change --.

Column 9,
Line 46, "much" should read -- a large --; and
Line 50, "secondary" should read -- secondarily --.

UNITED STATES PATENT AND TRADEMARK OFFICE

CERTIFICATE OF CORRECTION

PATENT NO. : 6,990,300 B2
APPLICATION NO. : 10/671690
DATED : January 24, 2006
INVENTOR(S) : Makoto Saito et al.

It is certified that error appears in the above-identified patent and that said Letters Patent is hereby corrected as shown below:

Column 10,
Line 4, “secondary” should read -- secondarily --; and
Line 57, “21pA” should read -- 21 μA --.

Column 11,
Line 12, “has” should read -- have --.

Column 12,
Line 1, “determinating” should read -- determining --; and
Line 62, “vie” should read -- view --.

Signed and Sealed this

Eleventh Day of July, 2006

JON W. DUDAS
*Director of the United States Patent and Trademark Office*